US005472381A

United States Patent [19]

Ayre, Jr.

[11] Patent Number: 5,472,381

[45] Date of Patent: Dec. 5, 1995

[54] METHOD AND ARRANGEMENT FOR APPLYING AND SECURING EDGES OF IMPROVED BOWLING LANE SURFACES

[76] Inventor: Fred P. Ayre, Jr., 321 E. Fairview St., Bethlehem, Pa. 18017

[21] Appl. No.: 251,483

[22] Filed: May 31, 1994

Related U.S. Application Data

[63] Continuation-in-part of Ser. No. 815,387, Dec. 31, 1991, Pat. No. 5,316,521.

[51] Int. Cl.[6] ..... A63D 1/04

[52] U.S. Cl. ..... 473/115; 473/117

[58] Field of Search ..... 473/115, 117; 52/408, 41; 156/71, 94, 152, 306.6, 389, 574, 577

[56] References Cited

U.S. PATENT DOCUMENTS

| | | | |
|---|---|---|---|
| 2,971,759 | 2/1961 | Blatt . | |
| 3,069,165 | 12/1962 | Kessler . | |
| 3,186,712 | 6/1965 | Kessler . | |
| 3,228,692 | 1/1966 | Brubaker | 473/117 |
| 4,205,842 | 1/1980 | Murrey | 473/117 |
| 4,221,620 | 9/1980 | Milne | 473/117 |
| 4,361,615 | 12/1982 | Kelly . | |
| 4,406,455 | 9/1983 | Berry et al. . | |
| 4,406,456 | 9/1983 | Berry et al. . | |
| 4,599,124 | 7/1986 | Kelly et al. . | |
| 4,867,816 | 9/1989 | Suiter . | |
| 4,944,514 | 7/1990 | Suiter | 473/117 |
| 5,084,381 | 1/1992 | Stirling et al. . | |
| 5,275,397 | 1/1994 | Heddon | 473/117 |
| 5,316,521 | 5/1994 | Ayre, Jr. | 473/115 |

OTHER PUBLICATIONS

"Bowling", First All Synthetic Lane Surface Approved by ABC for Sanctioned Play, Jan. 1977, p. 6.

*Primary Examiner*—Vincent Millin
*Assistant Examiner*—William M. Pierce
*Attorney, Agent, or Firm*—Charles A. Wilkinson

[57] ABSTRACT

An oiless surface for a bowling lane is formed from a high-density polyolefin and particularly a high-density polyethylene having a reduced friction surface with alternating high and low points. During bowling, a bowling ball passes over the high points without touching the low points, increasing the apparent lubricating of the surface to a point where no oil application to the surface is necessary and such surface can be referred to as "oiless". The oiless surface bowling lane is preferably provided in the form of a single continuous sheet forming such surface which may be transported to the lane site in a coiled condition and is also preferably retained tight against the lane base during actual bowling by a vacuum system which may also be used with other or non-oiless bowling surfaces.

19 Claims, 6 Drawing Sheets

65
16
67

65
67

71
73

19
17
69
71
15

49
51
55
53

21
63
57
63
57
23
49
59
59
13

23
49
21
63
59
13
57

METHOD AND ARRANGEMENT FOR APPLYING AND SECURING EDGES OF IMPROVED BOWLING LANE SURFACES

RELATED APPLICATIONS

This application is a continuation-in-part of U.S. application Ser. No. 07/815,387, filed Dec. 31, 1991, now U.S. Pat. No. 5,316,521; from which priority is claimed.

BACKGROUND OF THE INVENTION (1) Field of the Invention

This invention relates to bowling and more particularly to an improved bowling lane. More particularly still, this invention relates to a so-called oiless or oil-free bowling lane surface.

(2) Description of the Prior Art

As is well known to designers, builders and operators of bowling centers, as well as to the average bowling devotee, bowling lanes are subject to severe stresses and wear due to the weight of the bowling balls and the fact that such balls may not be deposited or rolled smoothly upon the surface of the lane, but may instead be lofted or lifted and then dropped upon the lane surface at the end of the bowler3 s delivery. Even where the ball is smoothly rolled down the lane without any significant lofting, the lane is subject to considerable force and wear during the rolling of a heavy bowling ball over the surface. Since bowling balls weigh several pounds and inherently roll or slide over the surface of the lane with only minimum surface-to-surface contact with the lane surface due to the spherical configuration of the ball, the physical forces developed directly under the bowling ball become quite severe due to the concentration of weight and any frictional components present at the small contact surface, which minimum contact surface is necessary to enable the ball to progress evenly and efficiently down the lane. During delivery, furthermore, the ball tends to be rotated backwards due to the swing of the bowlers arm during delivery. Such contra rotation increases the frictional stress upon the lane surface during initial contact with the ball. Lofting of the ball increases such effect due to the downward acceleration of the ball just before contact. The lane surface must be relatively hard and unyielding since, if the lane surface allowed the ball to sink significantly into it, such ball would always be trying to climb out of a hole or depressed portion in the surface with a considerable waste of energy as well as possible deviation of the path of the ball due to inequalities in the resiliency of the surface. The bowling ball must also be relatively hard and unyielding to prevent the ball from significantly deforming at its contact point with the lane surface. Any such deformation would result in a corresponding increase in retarding forces upon the ball and interfere with good directionality of the ball.

The traditional bowling lane surface has been formed of relatively narrow boards laid side by side with the narrow dimension vertically oriented. The boards have usually been laid with the edge grain oriented upwardly, often with the boards loosely connected to each other by a tongue-and-groove arrangement, and with nails physically holding the boards together in face-to-face relationship. Normally, a lane may be expected to last for twenty-five years or thereabout, depending upon the usage, so long as the surface is regularly sanded or otherwise equalized to remove damaged wood sections.

The American Bowling Congress, which generally polices the sport, requires that flatness of a lane be maintained within approximately 0.04 inch or less from portion to portion. To reduce damage the surface has normally been made from a hardwood such as maple underlain by a softer material serving as a somewhat cushioned base in the approach and impact lane section as well as the pin deck section and from a cheaper softwood such as pine in the intermediate lane section. Sanding of the surface of the lane to maintain its level and to remove damaged sections which may interfere with the progress of the ball can be continued usually until the vertically arranged boards are sanded down to where they may be partially interlocked with each other by a tongue-and-groove arrangement. If sanding proceeded beyond this point, the boards would lose their interengagement and the lane becomes completely unsatisfactory. Furthermore, where the boards are secured together only by nailing, which was standard in older lanes, sanding cannot proceed beyond a point at which the nails would be exposed. Periodic sanding is obviously expensive and many attempts and suggestions have been made by those in the art to provide a harder, more durable surface which will not wear as rapidly or preferably wear hardly at all. Various synthetic surfaces have been suggested either in the nature of overlays over the normal lane boards, such overlays being either in themselves physical structures or alternatively various synthetic impregnations of the upper surface of the boards. Other suggestions for compositions to fill in dents and inequalities in the surface have been made.

In recent years, most of the suggestions for hardening or otherwise improving the surface of a bowling lane and increasing its wear resistance have involved the use of synthetic materials such as, for example, a melamine external surface, see for example, U.S. Pat. Nos. 4,205,842 and 4,105,843 to G. W. Murray, which disclose the use of a high pressure laminate which simulates a natural wood surface. The use of synthetic surface dressing is also known. In fact, one of the principal surface dressings is ordinary mineral oil which is widely used to increase the playability of the lane surface to facilitate the slip of the ball upon the initial portion of the lane surface and to reduce wear. Such oil dressing came into widespread use just after the Second World War when widespread lofting of the ball by the players began and bowlers began to roll or actually to loft the ball from the middle of the lane rather than from one corner. It is possible to strike the pocket of the pins from one corner, although not at the best angle of approach, with a straight approach. However, the pocket can also be entered from the center of the lane or even the opposite side of the lane if the ball is rolled more or less parallel to the pocket with a side spin on the ball, which side spin causes the ball to curve or "hook" into the pocket.

The lofting of the ball with accompanying spin or "English" on the ball multiplies the stress on the lane surface because of the impact of the lofted ball with the surface, usually at an angle and with the ball spinning at the moment it hits the surface. Such spin not only increases the stress of the striking ball upon the surface of the lane, but also often severely heats the wood and overlying lacquer or other coating leading to splitting and splintering as well as actual micro charring of the wood fibers at the surface of the boards. The application of oil to the lane surface, on the other hand, to increase the lubricity of such surface, considerably reduces the friction of a spinning ball upon striking the surface and also, when a ball is lofted or physically thrown down the lane, decreases the initial impact by allowing the ball to slip upon the surface rather than to, in effect, plough into it. In other words, both the ball and the forces of impact are more easily deflected into parallel relationship with the surface rather than such stresses being directed into the interior of the boards of the lane. The oiling, in addition, has a considerable effect upon the type of game played by the bowler and the skill necessary to play the game.

As indicated, because of the initial triangular arrangement of bowling pins at the end of a bowling lane and the ultimate aim of the game to knock down as many pins as possible with as few bowling balls as possible, it is physically desirable for the bowling ball on the initial roll to enter the so called "pocket" between the leading pin and the following pins while traveling more or less perpendicular with respect to the side of the triangular arrangement of the pins. If the bowling ball strikes the pin arrangement at such perpendicular angle, it has a maximum probability of knocking down all of the pins at once. However, because of the length of the lane, it is physically impossible to roll the ball straight at the pocket at the required angle for most reliably knocking down all of the pins. Consequently, the next best approach may be to roll the ball, usually from the center of the lane, toward a point at which, if the ball has so-called side English or spin, attained by twisting the hand and ball to the side as it is thrown, such ball will, by the time it reaches a point down one side of the lane at which it is more or less opposite the "pocket," have assumed a diagonal movement made up of its original component of motion as it is propelled down the lane plus a transverse component of motion derived from its side English or spin. In effect, the ball assumes a curved overall motion on the surface of the lane not unlike the curve of a baseball thrown in a similar manner, except that the curvature of a baseball is attained by interaction of the spinning ball with the surrounding air, while the curvature of the bowling ball is attained by its interaction with the surface of the bowling lane, the rolling ball having insufficient speed or rotation to have significant interaction with the surrounding air. A further difference is that in the case of a baseball it is desirable to have a maximum curvature of the path of the pitched ball to interfere as much as possible with the aim of the batter at the plate, even though the increased curvature may also make it harder for the pitcher to aim the ball at any given area within the strike zone. With a bowling ball, on the other hand, since the bowling pins do not try to either avoid or strike the ball, it is advantageous for the bowler, so far as accuracy is concerned, to have as little curvature to the path of the ball as possible, while bringing or directing the ball into the pins at the most desirable angle.

A lesser curvature is also less stressful on the physical anatomy of the bowler and tends also to somewhat even the wide difference between the expert player and the average player, an important consideration in keeping the average player interested in the sport. It has consequently, as pointed out above, become the custom in many, if not almost all, bowling centers to provide a very light layer or film of oil upon the surface of the lane extending from the foul line for about twenty to forty feet down the lane. Such light film of oil decreases the initial friction between the ball and the surface of the lane, enabling the surface of the ball to slip more easily upon the surface of the lane and have, in effect, less interaction with the lane. Such slippage or sliding has two principal advantages for the bowler and one principal advantage for the lane.

The principal advantage for the lane is that when the lane is oiled, the lane will not be damaged or worn as much when the ball is laid or even dropped upon the lane, since the friction is not as great. Consequently, the lane is not worn as much by the initial contact of the ball with the lane and the time required for equalization of the speed of rotation of the ball can be greater and such equalization period spread over a longer portion of the lane surface. By the time the ball leaves the oiled section of the lane, it should have gradually reached a surface or rotational speed equivalent to the forward movement of the ball along the lane. In addition, if the ball has been aimed at the "pocket" between the first and the second pins, it will have been given side "English," or a side spin, by twisting the hand of the bowler sharply to one side or the other depending upon which pocket it is intended to enter. Such side spin, if there was no oil film on the lane, would also tend to wear the surface of the lane, but even more importantly, it would, if immediately applied, cause the ball to immediately begin rolling to the side providing a large component of side motion to the path of the ball. The resulting large curvature would mean that the ball would have to be rolled rather sharply toward the side of the lane away from the pocket and allowed to curve back into line with the pocket. While this is possible, it is, as indicated above, rather more difficult to control and to aim than a shallower curve. In addition, if the side spin or rotation of the ball is curtailed in order to flatten the curve and render the aim of the ball less difficult, such ball may, if there is no oil on the lane, not sufficiently spin and may easily be completely stopped or stopped dead so far as side rotation is concerned as soon as it strikes the lane surface so that very little ultimate sidewise motion at all is attained and it is impossible for the ball to enter the "pocket" at the most desirable angle. Consequently, while expert bowlers may be able to negotiate the lane successfully without oil upon the initial portion of the surface, it is much more difficult than when a desirable amount of oil or lubrication is used and even expert bowlers may find it difficult to strike the pocket at all.

When a thin layer of oil is supplied to the initial surface of the bowling lane, i.e. usually to the first 20 to 40 feet of the lane, as the ball strikes the surface of the lane, after having been either slid carefully upon the surface or having been lofted slightly and dropped upon the surface, the ball, when it first strikes the surface, has a component of sidewise rotation and hopefully also a component of forward rotational motion, although many less skillful bowlers may merely throw it down the lane with either no initial forward rotation or even a backward rotation. The initial rotational motion is, however, not as important if the lane is oiled since the ball will slide in the direction it is initially forcefully propelled with very little rotational motion and will, in effect, slide down the lane gradually building up rotational momentum as it starts to roll. Finally, at about the time the ball leaves the oiled portion of the lane, it will already be rotating in the desired forward direction it is supposed to go. In addition, the side spin or English placed upon the ball to the side will be maintained to the side with the ball initially sliding upon the lane to maintain its sidewise rotational momentum.

Since the surface of the oiled lane is, however, not completely frictionless, the sidewise rotational momentum of the ball will gradually cause the ball to start to move to the side until at the end of the oiled section of the lane, it will begin to move definitely to the side, or "hook," rather quickly attaining a sharp curvature to the side which, if it is lined up with the pocket, enables the ball to move directly toward the pocket beginning from a point much nearer the center of the lane than would otherwise be possible.

As will be seen from the above, the application of a small amount of lubricant in the form of a thin layer or film of lubricating oil has certain definite advantages in a commercial bowling establishment, as it renders the game less difficult for the normal bowler, while still maintaining ultimate difficulty for the expert and enabling the expert to demonstrate a superior mastery of the game. Such oiling of the lane also reduces, as explained, wear and tear on the lane.

A layer or thin film of oil, however, also has definite disadvantages. Among these may be listed the:

(a) The disadvantage of having to periodically renew the oil film, (b) the contamination of the ball with a thin layer of oil picked up from the lane, (c) contamination of clothing and hands with the oil, (d) ultimate contamination of the environment with the oil, and (e) the tendency of the oil to be carried down the lane by the surface of the ball slowly changing conditions of the lane and, in effect, the parameters of the game.

The last disadvantage is one of the most serious, since, as the oil is carried down the lane, the point at which the ball initially begins to roll, or hook sharply to the side will gradually change, lengthening somewhat for each consecutive bowler or contestant whereas it is important and desired to have identical conditions for each player. The oiling of the lane, thus, in effect, prevents the provision of level playing conditions for each contestant. In addition, the periodic renewal of the oil film and its application under strictly controlled conditions is difficult and expensive.

Related to the necessity to apply the oil film under strictly controlled conditions, so that the lubricity of the surface of the lane will be essentially the same from lane to lane and from one bowling center to another, is the propensity of some operators of bowling centers to deliberately place a heavy buildup of lane conditioner, or oil, at a strategic point to aid in directing the ball into the pocket. This increases scores making the local customers happy, but ruining competitive scores between centers. Such "lane blocking" techniques require close supervision by the American Bowling Congress (ABC) to maintain uniformity of bowling conditions throughout the industry.

It has been the dream of many in the industry to do away with the oil film and return to the original uniform conditions of the lane surface. Simply eliminating the oil has not been too attractive, however, since such action would quite likely eliminate many at least occasional bowlers, because of the additional difficulty of the game which such action would lead to. In addition, without the use of the oil, the usual bowling lane does not last too long, since the friction which is always present in bowling would quickly deteriorate the surface by localized overheating and other frictional effects, particularly where the ball first strikes and continuing down the lanes. Some attempts to eliminate the oil have involved merely the provision of stronger, more durable surface materials which can stand up to the frictional wear and tear upon the surface. Others have tried to eliminate the oil by supplying an inherently slippery surface either through composition of the surface or by the use of alternative dressing compounds. This approach has appeared particularly attractive as other types of synthetic surfaces have come into use. However, no really satisfactory oiless surface has hitherto been found.

Examples of attempts to use an inherently slippery surface or alternative slip-inducing dressings are the following:

U.S. Pat. No. 3,670,049 issued Jun. 13, 1972 to A. H. Stein et al. discloses the use of a polyurethane coating composition for finishing bowling lanes. The composition contains from about 0.2 to 10% by weight based upon the polyurethane polymer of a finely divided slip-inducing agent such as polyethylene. This patent thus attempted to combine the hard wear resistant but relatively high frictional characteristics of a polyurethane with the slip characteristics of a polyethylene.

U.S. Pat. No. 4,036,496 issued Jul. 6 19, 1977 to R. Robinson used a polysiloxilane or silicone material as a gloss-imparting agent for the surface of a bowling lane. This is an example of an attempt to provide a longer lasting, non-friction dressing or treatment other than a thin film of mineral oil.

It has been suggested not only to use small particles of polyethylene in the surface of a harder material, but to use a polyethylene or other synthetic polymer having smooth low friction surface characteristics as the lane surface itself. However, problems have been encountered with this simplistic concept and no practical system has been developed. In particular, difficulty has been encountered in keeping the low friction material aligned with itself since it is difficult to maintain a slippery material aligned together. For example, in the use of sheets of synthetic material, it is difficult to keep the edges of adjacent sheets aligned due to a tendency of the edges to be elevated slightly when a heavy bowling ball drops upon or even rolls across the middle of the sheet often depressing the center or middle and slightly elevating the sides or edges. While it is possible to glue down the sheets, adhesive does not, in general, adhere well to a low friction surface and the edges still tend to become elevated. Small inequalities in height between adjacent sheets cause undesirable vibration, small hops, retardation and possible very serious deviation of the path of a bowling ball. Furthermore, synthetic polymers tend to have relatively high coefficients of expansion with temperature changes which have not been easily matched with the coefficient of expansion of the remainder of a bowling lane or otherwise compensated for.

In addition, it is difficult to obtain a surface friction having the general frictional characteristics of an oiled lane surface which has now become the standard in the industry. It has also been difficult to identify a material having both satisfactory surface friction characteristics and strength and durability.

In the present Applicant's previous application, Ser. No. 07/815,387, filed Dec. 31, 1991, the surface of the bowling lane was described as being comprised essentially of individual sheets of relatively slippery synthetic plastic material having the special surface configuration of the invention. While the individual sheets, which are preferably attached to each other and to the lane surface by double-faced tape, have proven effective in practice, certain difficulties have become evident over a period of time. Among these are that with long continued use, the individual sheets sometimes become slightly warped due to the pressure of the ball rolling across them and striking them. Such warpage may be either temporary or relatively permanent and may result in the edge of one plastic sheet extending slightly above an adjacent sheet so that as a ball rolls from one to another it is retarded slightly by rolling or hopping up a slight elevation or rolls from one sheet down onto another. Because of the weight of the ball, the edge of a subsequent sheet is more likely to be slightly higher than lower. These inequalities are difficult to eliminate as a lane ages except by securely adhering the sheets to the underlying lane surface. Permanent adhering, however, in effect, means that a two-faced sheet cannot be turned over to renew a worn surface. Even with the sheets securely adhered to the base, furthermore, the weight of a rolling ball will tend to slightly depress the edge of an initial sheet over which it passes below the surface of a following adjacent synthetic sheet.

It is also advisable to leave expansion cracks or openings between the individual sheets, as explained in the previous application, which cracks can be sealed with a resilient filler, to prevent expansion of the sheets from forcing their edges upwardly at intersections between the sheets. However, with a decrease in temperature, the sheets will pull away from each other providing a crack which the ball has to traverse, possibly causing deviation of the ball. The resilient filler is not always effective to overcome the effects of such crack.

A further difficulty with the system described in Applicant's previous application is that while the use of double-sided adhesive tape to secure the plastic sheets of the invention to underlying structure and to each other is effective in holding the sheets down and also allows them to be readily taken up and reversed as well as to move laterally somewhat to allow for expansion, it has been found that while the sheets can be readily reversed if the lane is heavily used so that such reversal occurs within a few months of the original installation of the lane surface, if the lane is not heavily used and the sheets do not require reversal for a year or more, the adhesive of the tape may deteriorate or alternatively set so that the tape becomes very difficult to remove and leaves an adhesive residue which is not desirable upon the top of the sheet on the active lane surface when reversed.

There has been a need, therefore, for a low-friction, synthetic, long-wear bowling lane surface or lane construction. A need has also become evident for a lane system which does not have detrimental cracks between sheets, that does not warp and that does not require adhesive to secure to the underlying surface or base material.

Objects of the Invention

It is an object of this invention to provide a synthetic, low-friction surface suitable for use in bowling lanes which will provide the general slip characteristics of an oiled wooden lane surface or oiled synthetic material such as an oiled synthetic melamine surface.

It is a further object of the invention to provide a bowling lane having a low friction surface which will provide a uniform frictional contact with bowling balls over a significant period.

It is a still further object of the invention to provide a bowling lane surface having a serially discontinuous surface with an average uniform top portion along which a bowling ball may either roll or slide with equal facility.

It is a still further object of the invention to provide a frictional synthetic surface for bowling lanes and similar game-type apparatus which has a minimum retarding effect upon the passage of the surface of a bowling ball across such surface.

It is a still further object of the invention to provide a series of small uniform elevations in the surface of an active support for bowling balls across which the surface of a ball can pass.

It is a still further object of the invention to provide a bowling lane surface which will facilitate the rolling of a "hook" which will enter the pocket of the pins with increased reliableness.

It is a still further object of the invention to provide a surface for a bowling lane having a series of positive embossments which will facilitate minimum frictional passage of a bowling ball surface across the surface of the lane.

It is a still further object of the invention to provide a surface for a bowling lane having an irregularly discontinuous surface which facilitates the passage of the surface of a bowling ball with minimal frictional interaction, with said surface.

It is a still further object of the invention to provide a surface for a bowling lane having a regularly discontinuous surface which facilitates the passage of the surface of a bowling ball with minimal frictional interaction with said surface.

It is a still further object of the invention to provide an improved non-friction surface for a bowling lane formed of an embossed polyethylene surface.

It is a still further object of the invention to provide a material for construction of bowling lanes which has a relieved surface having high and low points with the high points sufficiently close together to support a bowling ball and relieved sufficiently to increase the lubricity of the surface over the lubricity of a smooth surface of the same material.

It is a still further object of the invention to provide a lane surface having a relieved surface with high and low spots provided upon a single unitary sheet of plastic having no openings between adjacent sheets as well as a procedure for installation of such a sheet preferably making use of a reel to transport the plastic sheet or strip.

It is a still further object of the invention to provide a means for holding down an oiless surface or other surface on a bowling lane comprised of a plastic sheet or sheets that makes use of a vacuum or reduced pressure holding system which may be used intermittently or continuously as necessary to hold down the plastic sheets.

Other objects and advantages of the invention will become apparent upon review of the accompanying drawings together with the attached specification and discussion.

Summary of the Invention

The present Applicant has discovered that a superior decreased friction surface for bowling lanes can be provided by the use of a dimpled or either positively or negatively embossed surface, preferably formed from a high-density polyethylene. The surface is preferably relieved in a regular pattern, but can be discontinuous in an irregular pattern so long as there is sufficient support for a bowling ball such that it may, in effect, pass over the surface with minimum up-and-down movement. The discontinuous or embossed surface is provided preferably on flat sheets of a synthetic material but may be provided upon other structural arrangements forming the surface of the lane. The surface may be used in new bowling lanes or may be easily retrofitted into existing lanes by attaching to the original wood or other lane surface. A preferred form of the oiless surface of the invention incorporates small cavities in the surface, but other discontinuous or relieved surfaces also have been found effective. It is preferred that the oiless surface be formed from a synthetic material having inherently fairly high lubricity characteristics or slipperiness which is increased by the physical structure of the surface. High density polypropylene is a preferred material in this regard. However, other materials can also be sued depending upon the particular construction or physical design of the surface.

The present Applicant has also discovered that a superior single sheet lane surface may be used to obviate the presence of cracks between adjacent sheets of his oiless lane surface and that the oiless surface, or indeed, any surface can be very effectively held down securely upon the lane surface by means of a vacuum system obviating certain disadvantages of other hold down systems. It has also been discovered that a single piece or unitary oiless lane surface in accordance with the invention can be very effectively transported and laid down upon the lane surface using a large reel plus preferably the temporary application of heat as the synthetic plastic material upon which the oiless surface is formed is placed upon or removed from the reel.

DESCRIPTION OF THE PREFERRED EMBODIMENTS

Figure 1:
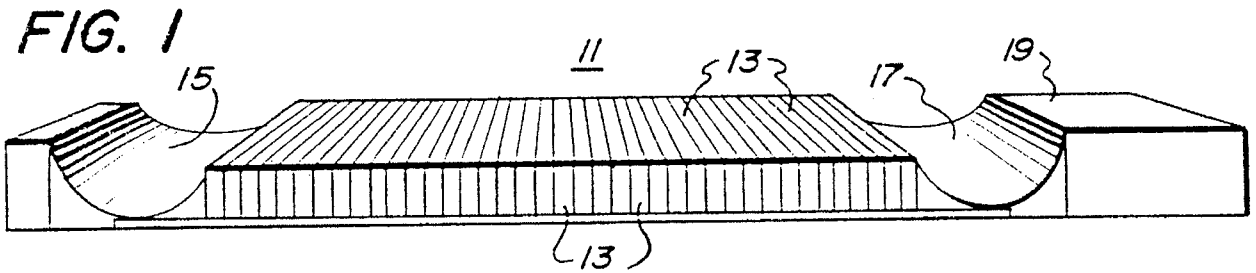
FIG. 1 is an isometric diagrammatic view of a portion of a typical contemporary (prior art) bowling lane showing the surface of the lane which can be covered by a synthetic material having a discontinuous surface in accordance with the present invention.

As indicated previously, there has been a need for a synthetic surface for bowling lanes which is sufficiently non-frictional, or has sufficient lubricity, with respect to bowling balls to act in the same general manner as an oiled surface of either a wood lane or an oiled surface of a synthetic lane such as one of the melamine surface lanes or other such lanes that have come into use in recent years. The present inventor has discovered that a superior non-friction surface can be obtained by providing an upper discontinuous surface upon which the ball rides only upon the tops or upper portions of ridges, individual pebbles or other elevations such as, for example, an orange peel type surface or the like of such discontinuous surface. Unexpectedly, such a physical surface has been found to provide a superior oiless lane surface. The distance between the individual raised elements of the surface must be close enough to each other so that the ball truly rides across the tops with no detectable, i.e. less than perhaps one or two mils or at most perhaps five mils, or thousandths of an inch, up-and-down, or vertical, movement. Too severe a vertical movement would tend to retard the forward movement of the ball. The elevated points of the surface should be spaced close enough to each other to relieve the ball from contact with a significant component of the nominal surface of the lane. It has been found that about 20 to 40% of the surface should usually be relieved or removed so far as contact with the surface of the ball is concerned. The preferred spacing and order of the high points of the surface should preferably be in a regular pattern. However, as indicated, it is also acceptable for the relief to be random. When using the discontinuous or relieved surface of the invention, no oil whatsoever is necessary to prevent damage to the surface, particularly by heat and impact, and the ball will handle essentially as on an oiled lane surface.

The normal surface of a bowling lane is, as indicated above, subject to extreme conditions of heat caused by friction upon contact with a rotating bowling ball. This is similar to the heat generated in the wheels of an airplane upon touchdown at landing where the burst of smoke observed from the tires at touchdown as the wheels are suddenly accelerated to rotate at the speed of the plane indicates the friction engendered in the tires as they are suddenly accelerated to landing speed. In airplanes, the wear on the tires is accepted. Although there have been many inventions for accelerating the wheels prior to actual touchdown, all or most have been deemed too expensive for actual use because of the extra weight and complication when compared to simply more frequently replacing the tires of the plane. In the case of dropping a spinning bowling ball upon a lane surface or rolling an initially stationary ball over the surface, however, it has long been the custom to oil the surface not only to reduce the frictional wear and deterioration of the surface from suddenly applied friction, but also to aid the bowler in attaining a correct angle of approach to the bowling pins. The oil, however, has numerous disadvantages, including cost of application and reapplication, general contamination including environmental contamination and varying lubrication of the lane surface as the lubricant is removed from its application area upon the surface of passing bowling balls and spread over other areas farther down the lane. This causes continuously varying lubrication of the surface both from time to time and from point to point. Such varying lubrication or lubricity is not conducive to good or uniform playing conditions.

The present inventor has unexpectedly found, quite by accident, followed by confirmation by lubricity tests and actual trials, that a relieved or discontinuous surface further decreases the friction of a relatively slippery material such as polyethylene or the like with the surface of a bowling ball passing over it if certain requirements are fulfilled. Such requirements are that the bowling ball be substantially supported upon the high points of the surface without significant up-and-down or vertical motion such as would use up the energy of forward motion of the ball across the surface and further, that the ball does not contact the lower portions or bottoms of the relieved portions of the surface. If these two requirements are met, it will be found that the relieved reduced friction surface will exhibit less friction with a bowling ball than a flat, smooth surface such as might be expected to provide the best non-friction characteristics with the surface. There is a range of parameters for the relieved or discontinuous surface, furthermore, in which the slipperiness or "lubricity" of the surface will be equal or even greater than the lubricity of an oiled surface of a bowling lane, allowing actual oiling of the surface to be dispensed with. If the point contact of the ball with the surface as it is rolled or slid across the surface decreases to the point where the bowling ball assumes a definite up-and-down progression across the surface, such surface will be unsatisfactory for bowling use since there will be too much retarding effect upon the ball. On the other hand, it is impossible to completely avoid some vertical movement of the ball on a relieved surface, except insofar as the velocity of the ball across the surface causes it to skip from one high point to another. In general, if the ball exceeds a vertical movement of about one or two mils or at most, it is believed, five to possibly 10 mils, too much energy will be used up in passing over the relieved surface, although the velocity of a rolling ball enters into the equation, since a fast-moving ball will experience slightly less drop between two contiguous high points. In general, the more relieved the surface is, the greater the apparent lubricity, with the proviso, however, that the ball not touch the lower portions of the relieved points or at least not touch a significant portion of such relieved points and, as previously indicated, that the ball be substantially held by the high points from substantial up-and-down movement. The relative effect depends somewhat upon the pattern of the high points relative to the low points, since some patterns will be more supportive of the ball. In general, it has been found that a relief of the surface of from 20 to 30% appears to be about optimum. However, a relief of 10 to 40% of the surface is operative in most cases and depending upon circumstances, i.e. the arrangement and structure of the high points, relief up to or more than 50% may be operative. In general, the relationship between the inherent lubricity of the material of the surface, the strength and abrasion resistance of the material and the design of the surface can be balanced to provide a lubricity similar to that of an oiled wood lane surface or an oiled synthetic lane surface. For example, a very slippery material, such as polytetrafluorethylene, may require less relief of the surface to attain the same overall lubricity than a less slippery material such as polyethylene. Furthermore, a material having a lesser strength may be used to provide adequate support of the ball by providing less relief of the surface, provided the lubricity is greater.

While the exact reason the relieved form of surface decreases the friction of the surface with respect to the surface of another smooth body such as a bowling ball is not presently completely clear, it appears to be at least partially due to a reduction of surface friction attained by reducing the amount of surface material the ball contacts in passing over the surface. However, from a theoretical viewpoint, any such reduction should be counterbalanced by differential pressure effects as well as by the increased unevenness of the path of the ball, however small such unevenness is. Apparently, however, this is not so, or at least is not of major importance, for small vertical movements of the ball. In addition, it appears that in some of the most effective, and, therefore, preferred relieved surfaces, the ball may entrap air in pockets on the reduced friction surface which entrapped air appears to allow the ball to, in effect, skip over the surface somewhat in the nature of a flat stone skipping across a body of water. This explanation, however, is evidently not the entire story since the invention is effective, although apparently not as efficient, when instead of there being pockets in the surface for the entrapment of air, there are instead a series of small protrusions over which the ball skips or rolls. The small, and preferably equally spaced protrusions, at least theoretically, do not restrict the air from flowing from beneath the ball as it moves across the surface. Consequently, when all is said and done, there does not presently appear to be either a definitive or even a good explanation of why the reduced friction oiless surface of the invention is effective in reducing friction.

There is, however, no doubt of the value of the invention in solving the problems previously mitigated by oiling the surface of a bowling lane. The increased lubricity provided by the invention, by allowing the ball to spin or rotate on the surface with very little friction, both decreases wear upon the lane surface and enables the same bowling technique to be used as on an oiled lane surface. This allows the bowler to better and more easily aim the ball at the pocket as explained above, and also reduces heat induced in the surface by friction which might otherwise deleteriously affect the synthetic surface, as oiling prevents deleterious heating and burning of a wood lane surface. The additional lubricity or slipperiness also reduces the force suddenly applied to the upper sheath of the lane surface when a ball is lifted and, in effect, dropped or thrown upon the lane with a forward motion when "lofting" the ball. Such jarring can easily displace a separate surface sheet, but with a good lubricity sheet there is little effective forward force imparted by the impact and therefore, little tendency to displace the sheet in any direction but down, where the force is dissipated by the support structures of the lane as well as by a preferred adhesive system developed by the Applicant and described hereinafter and in a projected separate application.

Other advantages and aspects of the invention will become evident from review of the attached drawings with reference to the following description and explanations.

FIG. 1 is a diagrammatic prospective view of a section of a typical bowling lane in accordance with long established practice and is, therefore, an illustration of the type of prior art lane arrangement to which the present invention may be applied or retrofitted. In FIG. 1, a lane 11 is comprised of a series of boards 13 fastened together by nailing or other means such as the present Applicant's prior invention described and claimed in U.S. Pat. No. 4,664,377 which ties the individual wooden boards of the lane together with tie bolts extending completely through the boards and applies a continuous biasing pressure to the sides of the boards by spring compression means to allow for changes in volume and shape due to humidity changes and the like.

At the two sides of the lane there are shown two gutters, 15 and 17, associated with the lane plus a section of a capping 19 for the ball return raceway, which capping is also sometimes used as a walkway for entrance of maintenance or other persons upon the structure of the lanes without walking on the lanes or gutters per se.

Figure 2:
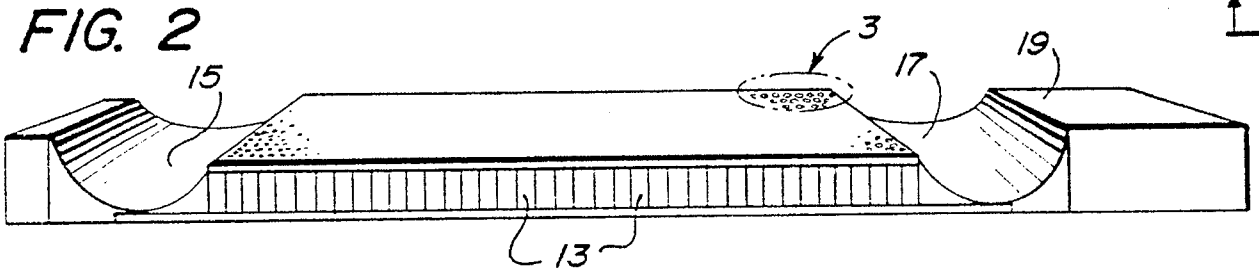
FIG. 2 is an isometric diagrammatic view similar to FIG. 1 showing a typical bowling lane having the synthetic sheet of the invention applied to the surface.

In FIG. 2, there is shown a bowling lane construction similar to that shown in FIG. 1 retrofitted with the reduced friction surface of the invention. Such surface, which comprises a discontinuous surface sheet 21 upon which there are raised embossments 23 in a regular pattern, as shown in greater detail in FIGS. 3 and 4, provides superior lubricity in accordance with the invention.

Figure 3:
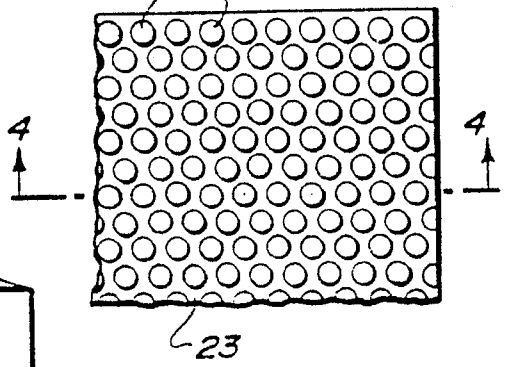
FIG. 3 is a top view of an enlarged portion of the surface of the synthetic material shown in FIG. 2 illustrating a somewhat preferred pebbled or positively embossed form of the surface.
Figure 4:
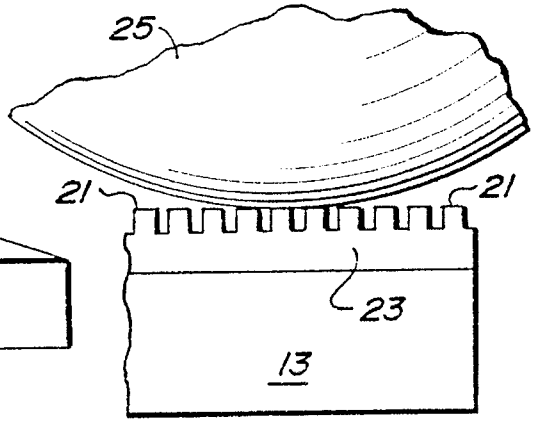
FIG. 4 is a side view of the portion of the synthetic material shown in FIG. 3 showing the pebbled or positively embossed surface from the side with a bowling ball superimposed upon the top.

FIG. 3 illustrates a preferred pattern of such raised embossments 23 on top of a non-friction sheet 21, while FIG. 4 shows a side view of the sheet shown in FIG. 3 upon which the embossments 23 are formed. The positive or male embossments 23 extend outwardly from the surface of a sheet or plate of reduced friction material 21 formed from a material having a low coefficient of friction such as, for example, polyethylene, polypropylene, polytetrafluoroethylene or other polyolefin material or other synthetic material such as nylon having a substantial compressive strength sufficient to receive the weight of a bowling ball from a significant height such as a free fall or drop of four feet or the like without being flattened significantly and sufficiently wear resistant to resist being quickly worn away. Sufficient strength to withstand significant lofting of the ball is, as indicated, necessary. High density polyethylene has been found to be very effective for this purpose. The area of the embossment has some effect in this regard in that an embossment of larger diameter has, in particular, more self-reinforcement. For example, the section of a bowling ball resting upon a section of one embossment 23, as shown in FIG. 4, extends upwardly from the base sheet 21. Such embossments 23 are spaced closely enough together to prevent a bowling ball 25 such as shown in FIG. 4 from entering to any great degree into the spacing or relieved portions 24 between the positive embossments 23. A ball rolling atop the surface of the sheet thus rides on the tops of the embossments 23 or skips from one to the other or between several at a time. The relief of the surface, therefore, causes the ball to contact less of the surface of the sheet for any given distancetraveled across the sheet. Alternatively, if the ball is rotating upon the surface without comparable travel across the surface, the ball tends to rotate against less of the underlying surface material at any given time.

Figure 4A:
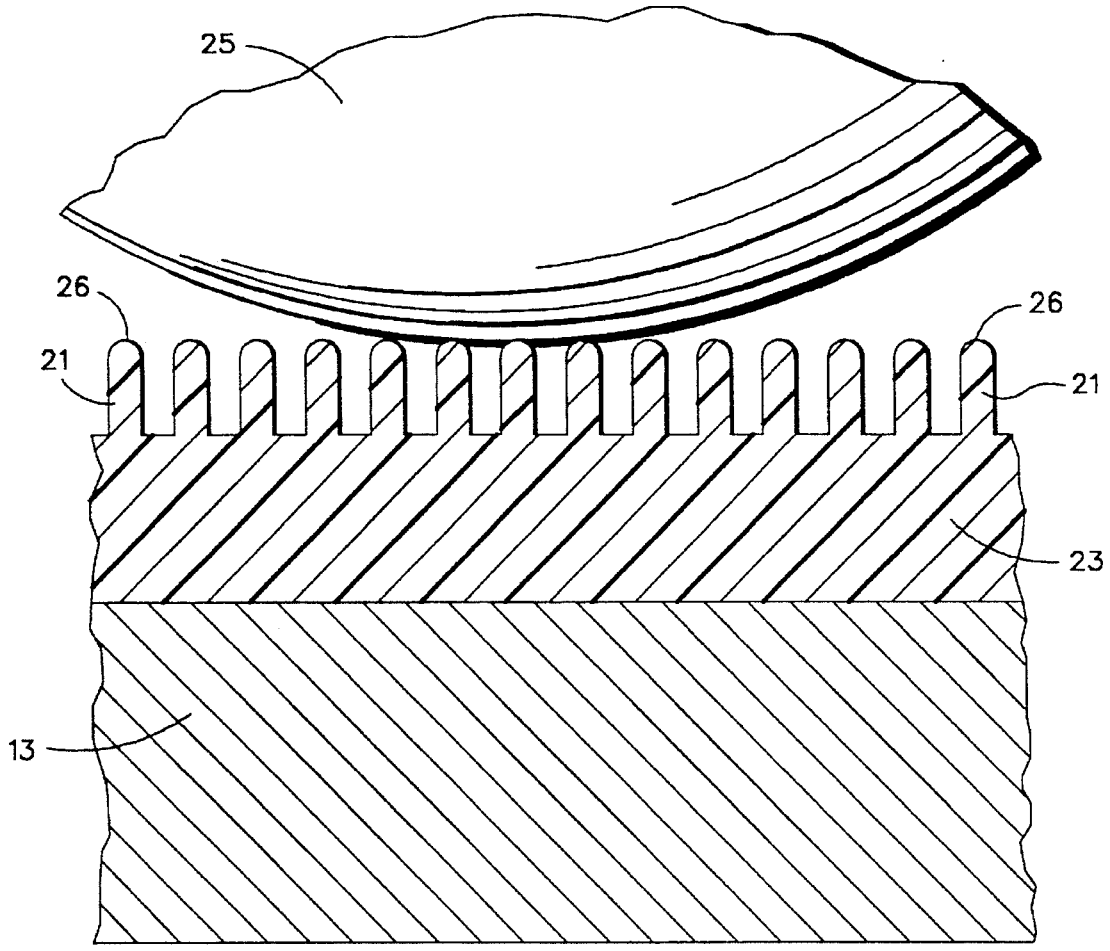
FIG. 4A is a view similar to FIG. 4 showing rounded upper surfaces on the positive embossments.

FIG. 4A shows a side sectional elevation similar to FIG. 4 of a variation of the positive embossment surface shown in FIG. 4 in which the tops 26 of the positive embossments are rounded rather than flat as in FIG. 4.

Figure 5:
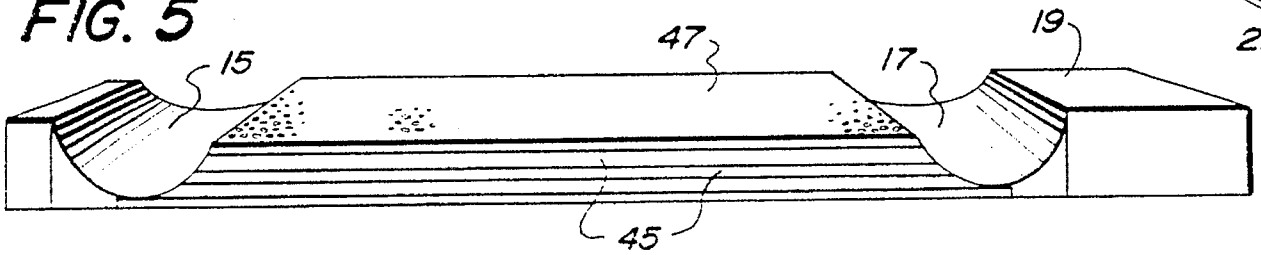
FIG. 5 is an isometric view of an alternative arrangement of the bowling lane shown in FIG. 1 in which the lane has been designed for receipt of a synthetic top layer with the non-friction surface of the invention and showing one embodiment of an oiless surface in accordance with the invention.

FIG. 5 is an isometric sketch of a section of bowling lane similar to that shown in FIG. 2, but in which an all-synthetic base is provided in the form of sheets or plates 45 having a thickness which provides an effective cushioned base to support the oiless surface sheet 47. Such a construction would normally be used in a new lane rather than a wooden base for the oiless sheets such as might normally be used in a retrofitted lane provided with the oiless surface of the invention.

Figure 6:
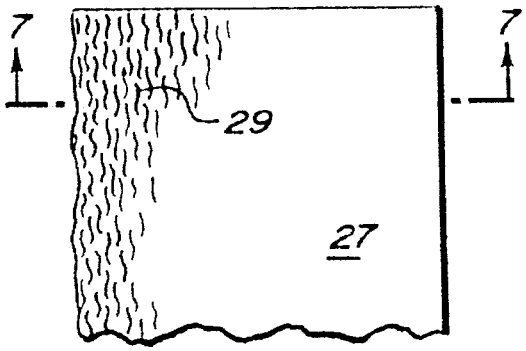
FIG. 6 is a top view of a further embodiment of the surface of the invention in which the discontinuous surface is irregularly discontinuous.
Figure 7:
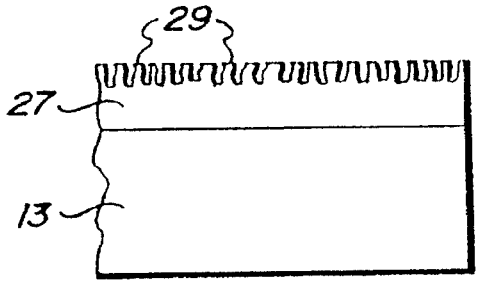
FIG. 7 is a side view of the embodiment of the surface shown in FIG. 6.

FIG. 6 shows an alternative embodiment of the invention in which the discontinuities in the surface of a sheet or plate 27 of reduced friction material are in the form of fairly narrow tortuous grooves or narrow openings 29 and the majority of the surface comprises an upper layer of fairly smooth reduced friction material including extensive sections of substantially flat surface. In general, the raised portions 31 of the surface are fairly extensive as made clear in FIG. 7, which is a cross-section of the sheet or plate shown in FIG. 6. There is little difficulty in keeping a bowling ball passing across the overall surface 31 without significant up-and-down movement, but the tortuous grooves or cracks in the surface are so restricted in width that the sheet surface is only somewhat more effective so far as lubricity goes than a smooth flat sheet. However, there is some improvement in lubricity over and above that provided by a smooth flat non-discontinuous surface of the same composition and the arrangement, while not the best, can serve as an oiless surface for bowling. The arrangement of FIGS. 6 and 7, therefore, while an improvement over a smooth flat surface, is one of the least preferred of the surfaces of the invention.

Figure 8:
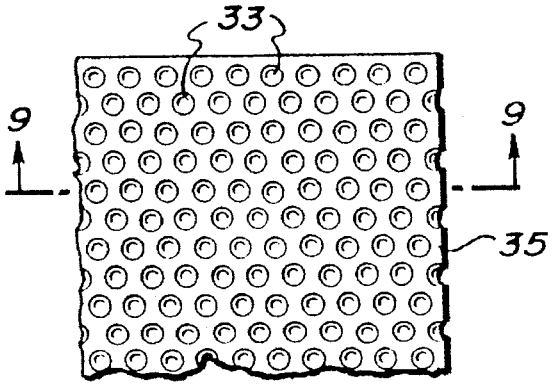
FIG. 8 is a top view of a preferred embodiment of the invention in which the low portions of the surface are in the form of small depressions in an otherwise flat or substantially flat surface.
Figure 9:
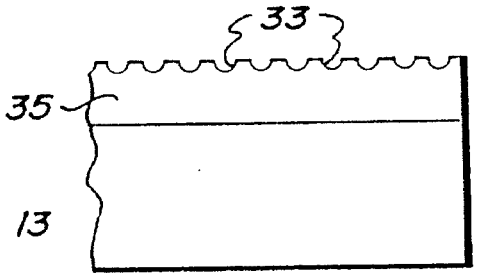
FIG. 9 is a side view of the embodiment of the invention shown in FIG. 8.

FIGS. 8 and 9 depict a further alternative and generally preferred embodiment of the invention in which a series of small cavities or cups 33 are formed in the surface of a reduced friction sheet material 35 leaving a network of remaining material 36 surrounding the orifices or cavities. This arrangement appears to provide superior results and it is believed this may be because, as the bowling ball passes over the small cups, it compresses a small amount of air within such cups so that the ball, in effect, skips from one cup to another or from one elevated surface to another across an intervening air cushion somewhat in the manner of a stone thrown against the surface of a pond.

Figure 10:
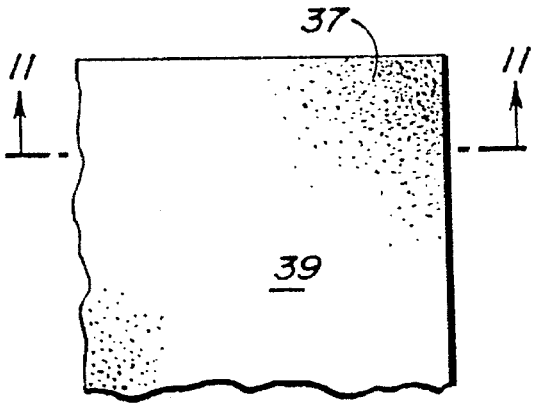
FIG. 10 is a top view of an embodiment of the invention in which the surface of the reduced friction material is in the form of a sandblasted surface having small pits and other discontinuities.
Figure 11:
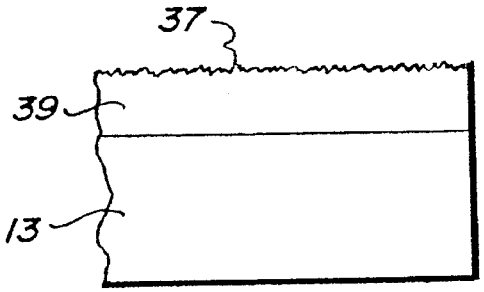
FIG. 11 is a side view of the embodiment of the invention shown in FIG. 10.

FIGS. 10 and 11 show a sheet or plate formed of a non-friction composition such as high density polyethylene, the surface of which has been roughened or made discontinuous by rolls or platens which have been themselves roughened by sandblasting or the like. Such sandblasting or other similar roughening treatment of the rolls or platens leaves, in effect, small irregular cavities or the like in the surface of such rolls or platens somewhat similar in effect and structure, except for their irregularity and to some extent their size, to the cup-type orifices shown in FIGS. 8 and 9 in the oiless sheet. These small cavities are transferred to the surface of a plastic sheet as a pebbled surface comprising a series of raised elevations upon the surface of the sheet by an elevated temperature pressure treatment of the plastic surface. In FIGS. 10 and 11, the stippled surface 37 identifies the small pebbled pattern upon the surface of the sheet. Very good results are obtained from such irregular pebbling or roughing of the base sheet 39 and such a surface has been found to provide a very effective, although not the most preferable, reduced friction sheet surface.

Figures 12, 13, 14, 15, 16, 17, 18:
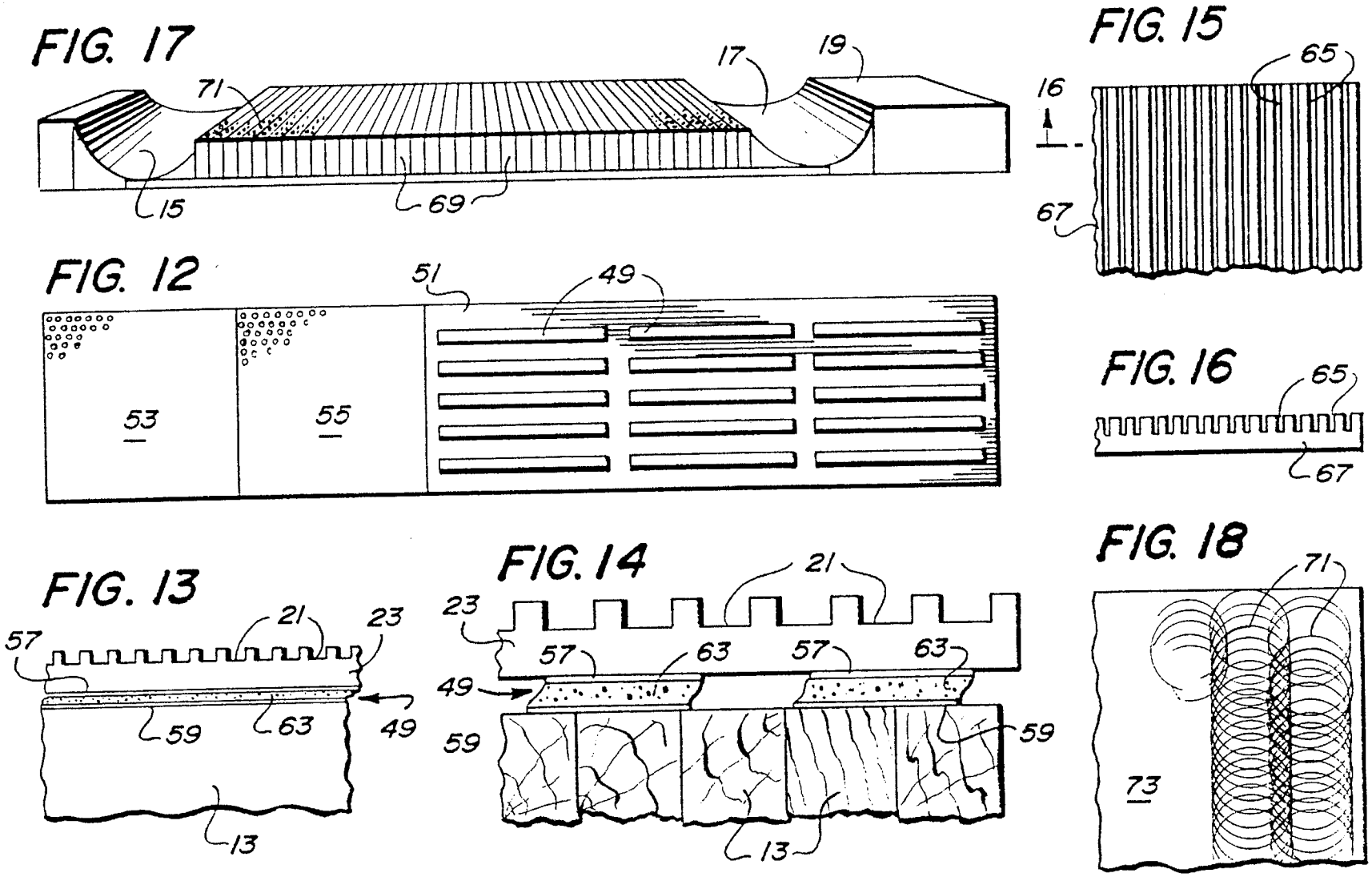
FIG. 12 is a top view of a bowling lane showing sheets of reduced friction material in accordance with the invention applied to one end of such lane by means of an adhesion system which is shown uncovered on the remaining section of the lane upon which the reduced-friction sheets have not been placed.
FIG. 13 shows an enlarged side view of a portion of the arrangement shown in FIG. 12 showing a reduced friction sheet in accordance with the invention adhered to the top boards of a conventional bowling lane by a double-faced tape.
FIG. 14 is an end view of the adhesion system shown in FIG. 13 for adjustably adhering the top sheet to the underlying structure of the lane.
FIG. 15 is a top view of a section of a less preferred embodiment of the invention in which the reduced friction sheet is provided with a series of transverse score lines or grooves across the sheet.
FIG. 16 is a side view of the reduced friction surface arrangement shown in FIG. 15.
FIG. 17 is an isometric view of an arrangement of the invention in which the surface of the bowling lane is formed from a series of board-type members similar to the normal boards of a wooden bowling lane, but formed from a reduced friction material such as high density polyethylene and having the reduced friction discontinuous surface of the invention on the upper surface of each individual "board".
FIG. 18 is a top view of an alternative embodiment of the invention in which the relieved surface has a curved pattern of high and low points.

FIGS. 13 and 14 show the Applicant's preferred method of attaching a retrofitted anti-friction surface in accordance with the present invention to an existing bowling lane surface. It has been found that polyethylene sheets, for example, have a fairly high coefficient of expansion or contraction with changes in temperature. Such high coefficient of expansion, which is greater by about at least one magnitude than that of the usual wooden lane boards, causes the polyethylene to tend to buckle, particularly if attached directly to the lane beneath or to the supports for such lane. Extreme difficulty has, in general, been encountered with the attachment of synthetic material to the lane surface because of difficulty with such buckling occurring in a large number of cases. The present Applicant has discovered that such difficulties occasioned by differences in thermal expansion of the underlying lane and the overlying lane surface material may be completely eliminated, or at least substantially alleviated so they are no longer serious, by the use of an adhesive system involving a double-faced semi-flexible material such as sheet or tape having its adhesive supported or carried upon the two sides of a flexible elastic membrane such as a sponge, plastic or rubber material. The double-sided adhesive system may be adhered to the surface of the lane preferably lengthwise with the wooden members and the sheet of polyethylene laid down upon the other side of the tape. When the plastic or synthetic material then expands lengthwise compared with the underlying lane surface, such expansion will draw the upper adhesive layer of the double-faced adhesive system along with it, while the lower layer of adhesive stays attached to the underlying wooden lane surface, the adjustment between the two taking place in the resilient central core of the adhesive system, which by stretching, allows the two surfaces to be adjusted to new relations between the two.

The described adhesive system arrangement is shown in FIGS. 12 through 14 which in FIG. 12 shows a preferred arrangement of double-faced tape 49 in 5 parallel strips or rows down the length of a conventional bowling lane 51 with two sheets of friction-reducing material 53 and 55 in accordance with this invention already adhered to the surface of the tape at one end of the lane. Such arrangement provides a very stable and effective means for holding the surface sheets to the underlying lane structure. The present Applicant further describes and claims this method for adhering various synthetic materials to underlying lane materials in a related application. Tape may also be arranged transversely across the lane directly under the abutting edges of the sheets thus aiding in both holding the edges of the sheets down as well as holding them together. The arrangement shown in FIG. 12 is particularly desirable since it allows double-faced oiless sheets to be used whereby when one side of the sheet becomes worn, the sheet can be lifted up, flipped over and reapplied to the adhesive tape with the unused side upmost. The tape adheres more tenaciously to the underlying wooden lane than to the plastic material, allowing the sheet to be easily lifted off.

FIG. 13 is an enlarged longitudinal view of the sheet and tape applied to the lane, while FIG. 14 is a transverse view of the arrangement. The surface sheet 51 is secured to the underlying lane boards 41 through the agency of double-faced tape 49 having an upper adhesive surface 57 adhered to the non-friction sheets 41 and the lower surface 61 adhered to the wooden lane boards 41. A flexible elastic central portion 63 in the tape provides adjustability.

FIGS. 15 and 16 are respectively a top view and a side view of a less preferred embodiment of the invention in which the discontinuous or relieved surface is in the form of a series of parallel grooves 65 and ridges 67 in the underlying reduced friction sheet material 68 which grooves and ridges may be arranged transverse to the lane and across which the ball may progress. This arrangement is not preferred, but has been found to be effective in reducing friction to provide a satisfactory oil-free surface.

A further arrangement for an oil-free surface is shown in FIG. 17 in which the lane surface, instead of being provided on one or both sides of a sheet or plate of non-friction material, may instead be provided on the top edges of a series of individual plastic members or stringers 69 which are arranged very much as the conventional wooden boards are arranged in a bowling lane, the two gutters 15 and 17 of which are also seen in FIG. 17. On the top surface of each stringer or board 69 are a series of discontinuities 71 which are in the form, in the case illustrated, of small depressions in the surface which provide the superior oiless surface of the invention.

The individual plastic boards 69 of FIG. 17 are preferably aligned with each other by adjoining grooves, not shown, routed in each side with a deposite of a hardenable glue or hard caulking extending from one groove to the other to maintain vertical alignment. Alternatively, a spline piece may be fitted between the grooves to align the resin "boards". Of course, the resin or plastic boards may also be extruded with an alternative tongue and groove construction, but this expedient will normally prove too costly. The resin boards are preferably held together by the spring biasing arrangement disclosed and claimed in Applicants prior U.S. Pat. No. 4,664,377 issued May 12, 1987. The arrangement shown in FIG. 17 is very strong and solid and allows the oiless surface of the present invention to be used on both the top and bottom of the individual boards for reversing when necessary to provide a new surface.

FIG. 18 is a diagrammatic top view of an oiless lane surface in accordance with the invention in which the relieved portions are in the form of a series of intersecting circles or spirals such as may be obtained by rotary sanding of the surface. This expedient has been found to be effective in providing an oiless surface, but is not a preferred method as it tends to be non-uniform on both a macro and micro scale. It does illustrate, however, the applicability of curved relieved portions on the lane surface. The sheet or plate 73 in which the ridges and the depressions 71 for provision of an oil-free surface are provided is formed from the preferred high density polyethylene material of the invention.

While a preferred method of holding down or mounting the plastic sheets having the oil-free surface of the invention is shown and described in connection with FIGS. 12, 13 and 14 of the present disclosure, other methods of mounting or securing the sheets upon the underlying lane structure can be used. For example, the sheets can be secured to the lane surface or base structure by a contact type glue applied between the two or by means of bolts or other fastenings received in slotted openings to allow for periodic expansion and contraction of the plastic sheets with changes in temperature. The sheets can also be interlocked or partially interlocked with each other at their ends or transverse edges by interengaging scalloped or other regular or irregular matching patterns which have been found to be very effective or by the more usual staggered interdigitation-type splicing. If the ends of the sheets are merely abutted along a straight line, it is desirable to have them meet at matching forty-five degree angles with the upper overlaps extending in the bowling direction. Alternatively, the two ends may be straight butted with a resilient caulking material applied between the ends as is occasionally done when using other types of synthetic lane surfaces.

As indicated above, the material used to form the oiless surface is preferably an ultra high molecular weight or high density polyethylene. A suitable material is sold by Poly-Hi Menasha Corporation of Fort Wayne, Ind. and Scranton, Pa. under the general Trademark "Tivar". However, other low friction materials such as polypropylene, as well as some other polyolefins, polytetrafluoroethylene and other fluoro carbons, polyamides such as nylon and the like can also be effectively used. The requirements are that the lubricity of the material when fabricated or otherwise supplied with the relieved surface of the invention be substantially equal to that of an oiled wooden or synthetic lane dressed or conditioned in accordance with the specifications of the American Bowling Congress and sufficiently supportive and durable to adequately resist the weight and wear of conventional bowling balls dropped upon or rolled over such surface when provided with the particular relieved surface of the invention effective to provide the required lubricity. Most nylons have adequate strength. High density polyethylene also has such strength and some modern hard polytetrafluorethylene or related fluoro or chloro polymers have such strength and slipperiness, although other more conventional polytetrafluorethylenes tend to flow too easily at room temperature under a continuous stress.

The amount of relief of the surface may, as indicated above, be from approximately 10% to 50% or more and is preferably between about 20% and 40% in most designs. However, the exact amount depends upon the base material and the type of relief pattern. The average distance between the high points of the relief pattern is believed to be preferably between 0.25 mils and 250 mils, or thousandths of an inch, although the precise limits are at present somewhat uncertain. An average distance between high points of approximately 25 and 40 mils has been found to be very satisfactory with a high density polyethylene sheet material and the usual 6 pound bowling ball.

The best and most effective pattern of high points upon the surface is believed to be a regular pattern which allows a very even passage of a bowling ball over such high points. However, a random pattern of high points which incorporates some of the aspects of the best pattern with less efficient patterns has also been found to be very effective.

The non-friction surface of the sheet of the invention can be left its usual white or cream color or can be colored to resemble the usual wood lane surface. High density polyethylene can be colored by heating the surface preferably in combination with ploughing or scratching the surface, applying a pigment and then compressing the surface with a platen or the like to permanently incorporate the pigment in the surface. The pigment does not interfere with the preferably later formed pebbled or other texture of the surface.

As noted above, while the double-sided friction tape described previously as a preferable way of retaining the oiless coating surfaces upon the bowling lane has proved both practical and successful, it has been found to have certain drawbacks, particularly when used on lanes which may not experience very rapid wear due to high usage and where the sheet material incorporating the oiless surface on both sides may, therefore, not be ready to be turned over for a significant period of time. As explained, it has been found that the double-faced tape may in such cases be found to be permanently adhered to the surface of the material incorporating the oiless surface and almost impossible to remove except by scraping the surface or by the use of a strong solvent allowed to soak the tape for some time. Both scraping of the surface as well as removal by solvation have serious potentials for injuring or degrading the surface. Any such degradation is clearly unacceptable, or at least very undesirable, since the reason for embossing both sides of the sheet material with the oiless surface is to be able to turn the sheets over so that a fresh unworn or undegraded surface may be used as the upper bowling lane surface. Consequently, while the double-faced tape may be quite satisfactory for use in very high usage lanes, it may be disadvantageous, particularly where double-faced oiless sheets are used, as is usually preferable in order to obtain additional wearing surface upon a single or the same sheet.

It has also been found, particularly in high usage bowling lanes, that the oiless sheets may become either temporarily deformed or warped as the ball rolls over them, or even permanently deformed from the effects either of the ball rolling across the sheets or of a contraction and expansion of the sheets with temperature changes. Essentially, as the ball rolls down the lane and passes from sheet to sheet, the sheet upon which the ball is rolling is depressed by the weight of the ball, while the sheet upon which the ball does not rest is not depressed and, consequently, will extend slightly above the surface of the adjoining sheet upon which the ball is rolling. As a result, when the ball passes from a first sheet to a second sheet, the surface of the second sheet may be slightly, in the neighborhood of a fraction of a millimeter or so, higher than the adjoining side of the last sheet so that the ball, in effect, is forced to "hop up" every time it goes from one sheet to another. The force of the ball as well as the force of expansion and contraction between the sheets may also cause the sheets to warp somewhat so that the surface of one sheet may have a slightly different elevation from the surface of an adjoining sheet. Furthermore, where a series of individual sheets are laid down, in order to allow for expansion of the sheets with temperature changes, it is necessary to provide significant cracks or openings between the individual sheets to allow for expansion in the sheets under advanced temperature conditions. This may be particularly critical where there are significant temperature changes, for example, during the night when the bowling lane may become cooler and during the day when it may become hot due to usage of the bowling lanes or, vice versa, where the bowling lanes may be cooler during the day due to forced air conditioning and warmer at night when the air conditioning is either turned down or turned off. If the cracks between the sheets were not provided, the sheets might be forcibly moved against each other causing the entire lane to buckle, a serious occurrence, which may upon occasion completely ruin a lane. However, the provision of clearance or cracks between the separate sheets to allow for expansion also provides small grooves down which the ball may temporarily dip as it passes from sheet to sheet, causing a deviation or even bounce of the ball. While, as explained above, this disadvantage can be counteracted by filling the cracks between the individual sheets with a flexible sealing compound which will be able to support the surface of the ball momentarily, particularly where the ball, in effect, is contacting two adjacent sheets at the same time, such sealing is never completely satisfactory, since in order to be flexible enough to allow the expansion and contraction of the sheets, the sealing compound must also be flexible enough so that it is likely to be depressed by the passage of a ball over it more than the adjoining sheet surface, thus in effect, at least partially defeating the principal purpose of providing the flexible sealing compound between the sheets.

The present inventor has found that these difficulties, as explained above, can be obviated by the use of a continuous oiless sheet upon the surface of the lane. While continuous lane surfaces have been used before, such lane surfaces have been very thin veneers placed upon the surface primarily to provide either the appearance of a wood surface or to provide a fairly long-lasting, but easily replaceable, actual lane surface. However, since the oiless lane surface must have sufficient thickness to allow such surface to be embossed with hills and valleys or high points and low points across which the ball may pass, the oiless lane surface by necessity has to be thicker than the artificial continuous lane surfaces previously used. Usually a sheet embossed upon both sides with high points and low points should be at least three-sixteenths of an inch in thickness. In addition, the previous artificial lane surfaces have been largely adhered to the underlined lane surface in order to prevent them from wrinkling due to either the friction of the ball on the surface or due to temperature changes causing expansion and contraction of the surface. However, as explained above, it is desirable with the applicant's oiless lane surface not only that the surface be embossed upon a thicker material than has heretofore been generally used as artificial surfaces upon bowling lanes, but also for the oiless lane surface to be embossed on both sides of the oiless sheet. In this way, it is possible to turn the sheet over after one side is worn and immediately have available a completely new oiless lane surface. If the lane surface material was securely adhered to the underlying lane structure, however, it would be largely impossible to turn the sheet material over and the only thing that could be done would basically be to scrap the oiless surface material or re-emboss the surface. A better way of securing the oiless lane surface to the surface of the bowling lane itself has, therefore, been desirable.

The present inventor has now found that his previous invention can be beneficially improved by providing a continuous undivided lane surface having no cracks between individual sheets and free at the sides and ends to move in accordance with temperature changes. This allows the entire surface material to expand and contract as necessary with temperature without causing buckling or warping of the sheet. In addition, a single lane surface supports itself from all points so that a ball rolling across the surface is not able to depress the edge of one sheet as it is leaving such sheet, while the edge of an adjoining sheet is extended upwardly causing the ball to hop up the differential height between the two sheets. Instead, where a continuous lane surface is provided, while the ball may depress by its weight to a slight extent any particular point of the surface upon which it is resting or moving across, the attachment of such point on all sides to adjoining portions of the lane material tends to equalize any depression so that there is never a slight ledge over which the ball has to hop, but at most, a very gentle slope up which the ball may roll, as it does in fact over any surface.

The present inventor has also discovered that a very effective way of reinforcing the surface sheet on a bowling lane or holding it down upon the underlying lane surface is by vacuum application to the underside of the sheet so that the entire sheet is pulled downwardly with a uniform downward force tending to flatten it at all times and prevent it from moving as a ball moves across the surface. This flattening or adhesion of the oiless lane surface to the underlying lane structure is accomplished without damage to the sheet or lane surface itself and may be completely inactivated at any time, allowing the sheet to be removed from the lane surface and turned over, at which point the vacuum may be re-applied to re-secure or clamp the sheet down to the base surface of the lane. In some cases, the vacuum may even only be necessary at the time at which a new sheet is applied to the lane surface or until such sheet becomes straightened out or thoroughly flattened, at which point the vacuum can be discontinued and the sheet will be held to the surface effectively by mere gravity. If the sheet tends to move, however, the vacuum may be turned on at any time to re-apply whatever adhesion is necessary to keep the sheet securely against the underlying surface.

It has also been found that it is very advantageous when a vacuum system is used to have the underlying sheet formed from a metal material or sheet having a number of regularly spaced equal height upward protrusions which will thoroughly and equally support the oiless surface sheet material from the bottom while allowing vacuum to be applied to the bottom surface of the oiless sheet between such protrusions to pull it down against such protrusions. In this way a very solid and vibration-free playing surface is provided to the lane. The metal base surface is provided along the edge with a large O-ring or series of resilient O-rings to seal the edges with the oiless sheet and maintain the necessary vacuum.

It has also been found that the one piece oiless surface sheets of the invention can be very suitably transported to the bowling lane site on very large reels which, because of their large diameter, do not seriously bend at any point the relatively thick material of the oiless sheet material and therefore do not place serious stresses in the sheet or even risk fracture of the sheet. Consequently, after embossing of the sheet by a suitable embossing machine at an original fabrication point, a continuous oiless sheet material may be drawn onto a large reel of, at least in most cases, six feet or more in diameter. If necessary, such reeling may be accomplished in conjunction with the application of heat to the surface of the oiless sheet material from, for example, heat lamps or the like to facilitate bending of the sheet so that it will pass smoothly onto the large diameter reel and lie smoothly against the reel until it is wished to remove it from such reel. The size of the reel will, in general, be selected such that the particular thickness of sheet material will not be bent during the sojourn on the reel sufficiently to over stress the synthetic plastic material such that it will not return to a flat condition when unreeled under the conditions of reeling and unreeling. When it is necessary to remove the sheet from the reel, the reel will merely be rotated in the opposite direction and the sheet expelled or unreeled, again, if necessary, simultaneous with application of heat to the surface of the sheet to allow it to be straightened out. The heat not only allows the sheet to be more easily bent or straightened out, but, particularly in the case of straightening the sheet out, reactivates the original "memory" of the plastic material for the straight condition so that the sheet is more readily laid upon a flat surface. In most cases the reel will be merely rolled along the lane allowing the continuous sheet to be unreeled directly upon the surface of the bowling lane while a heat applying source is moved along just after the unreeling point of the sheet to aid in flattening the sheet by counteracting residual memory in such sheet. The improvements made to the invention in accordance with the above explanation may be more readily understood in conjunction with the attached FIGS. 19 through 26, attached hereto, in light of the following description.

Figures 19, 20:
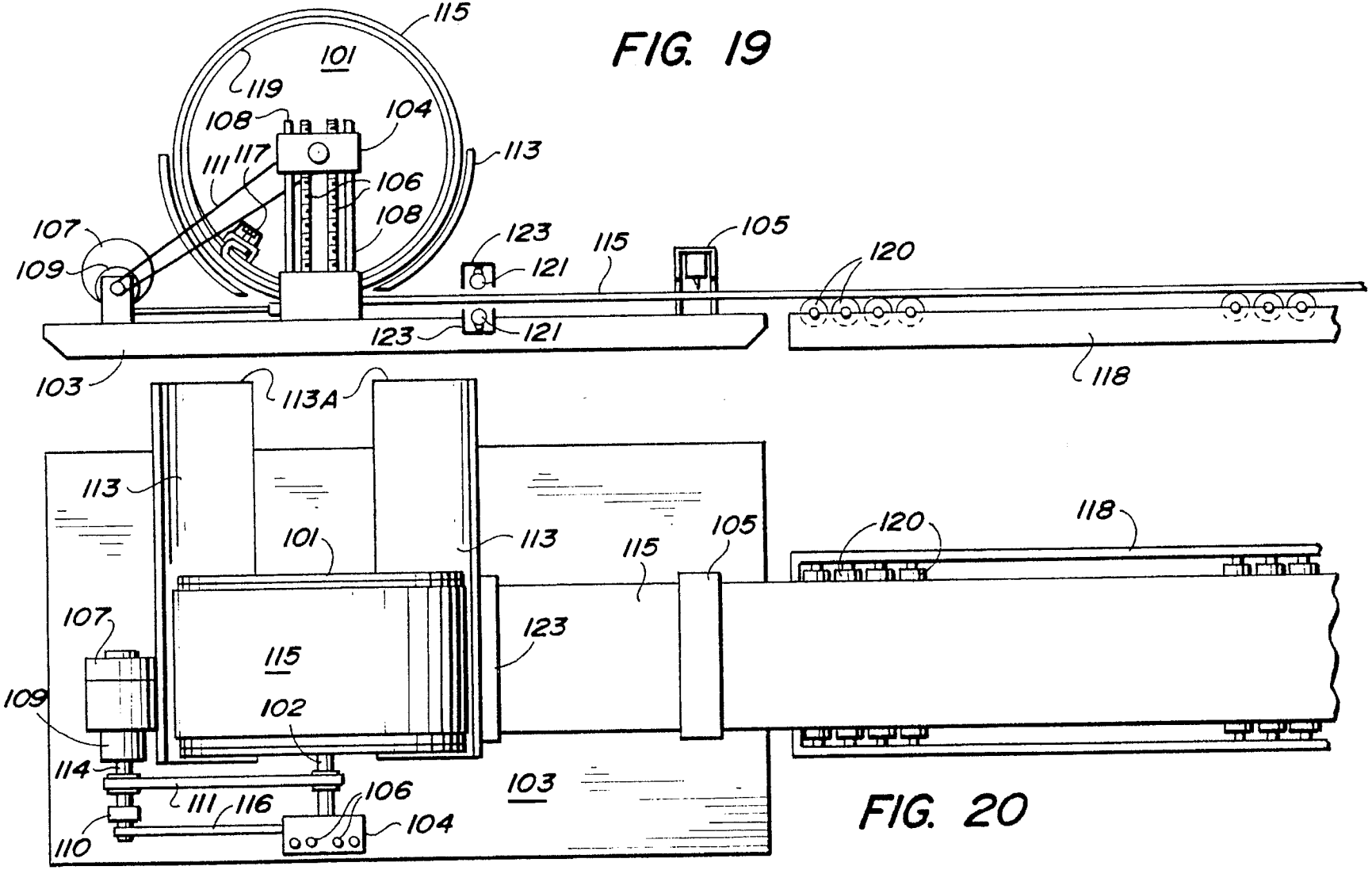
FIG. 19 is a diagrammatic side elevation of an apparatus for coiling continuous undivided lengths of oiless surface sheet material upon a bowling lane reel for delivery of a single section length to a bowling lane in accordance with the invention.
FIG. 20 is a diagrammatic plan view of the coiling apparatus shown in FIG. 19.

In FIG. 19 a large reel 101 is shown mounted upon a skid 103 which serves as a base for the reel during reeling as well as motor power for the reel as well as any necessary heating apparatus and preferably a synchronized cutoff apparatus 105. A motor 107 and gearbox 109 are provided at one end of the skid 103 and are attached to the reel through suitable pulleys by belt mechanism 111. The reel 101 may preferably be surrounded on the lower side of the reel by support cradle 113 which serves to prevent the continuous oiless surface sheet material 115 from sagging from the surface of the reel or drum 101 and also allows the reel 101 to be unloaded, when full, from its mounting. In such case, the reel is drawn out upon the extension 113A of the extension of the cradle, banded and prepared for shipping. A clamp 117 is provided within the interior of the reel 101 on a surface which serves as a slightly displaced inner surface of the outer surface 119 of the reel 101.

The reel mechanism itself may be desirably supported on a central axle 102 in a cantilever fashion from a heavy vertically elevatable bearing block 104, best seen in FIG. 2, which can be progressively elevated in coordination with rotation of the reel to allow for increasing layers of sheet material upon the surface 119 of the reel. Coordinated elevation of the reel as a result of elevation of the bearing block 104 is effected by rotation of vertically oriented screw-threaded shafts 106 passing through the bearing block which is also guided and transversely supported by guide rods 108 which pass through the bearing block. Rotation of threaded shafts 106 is coordinated through gear boxes 110 and 112 in conventional manner with power derived from the gear box 109 through shafts 114 and 116.

It will be understood that subsequent to the fabrication of the oiless surface sheet material usually by extrusion, not shown, followed by embossing, not shown, of the surface of the oiless sheet surface sheet material 115, preferably on both sides, such oiless sheet material, which will usually have been embossed in a flat condition, will be propelled or moved across a roller or other material transport surface 118 having rollers 120 to the reel apparatus and will have an end clamped within the reel 101 by means of the clamp 117. The motor 107 will then be operated to draw the continuous oiless sheet surface material onto the large reel 101 which, as indicated above, should usually be at least six feet in diameter and sometimes more, so that the oiless sheet material 115 is bent as little as possible. As the reel turns, the bearing block 104 is raised to raise the reel 101 proportionally to the number of layers of oiless sheet wrapped upon the surface.

It has been found that a reel diameter of six feet may be moved through most doors in the usual commercial buildings. Consequently, it may be desirable not to make the reels 101 larger in diameter than six to seven feet. However, in those particular conditions where larger doors or openings through walls into bowling lanes may be available, the reel can be made larger with desirable results. The actual reel size will be dependent upon the thickness of the sheet material, thicker sheet requiring larger reel diameters, other things being equal, than thinner sheet material. If there is difficulty in reeling the material on the reel 101, the sheet material 115 may be heated by suitable heating apparatus such as by a series of infrared lamps 121 mounted in reflectors 123 adjacent both the bottom and top of the sheet material, as shown in FIGS. 1 and 2. Such heating will be sufficient to cause the sheet material to bend sufficiently so it may be reeled upon the reel 101 without any danger of engendering residual stresses in the material or even fracture of the material by heating the outer portions of the sheet material which cool the most rapidly. As may be understood, it is particularly important that the surface of the sheet not be fractured, since any such fracture may serve as a locus for a propagating fracture crack which may cause the sheet to crack completely across its surface causing, in effect, two continuous pieces of sheet material instead of a single continuous sheet. Also, any crack in the surface may itself serve as a disturbance of a ball passing across the surface during use of the lane. Usually, however, the principal importance of the heat is to counteract the cooling of the upper and lower surfaces and counteract the residual memory in the plastic of temporary straightness as well as remove or counteract compressive stresses on the inner surface and tension stresses on the outer surface as the sheet material is coiled. The center of the sheet which may still have residual heat in any event from extrusion, if recently made, is not stressed as much as the surface portions of the sheet. Consequently, it is not critical if the heat from the heating lamps or other means does not extend through the entire sheet.

After the sheet material 115 is reeled upon the large reel 101, the entire reel will be loaded upon suitable transportation means such as a truck or train and moved to a bowling lane where the large reel may be moved in adjacent to the end of the lane. The reel may then be rolled along the lane, as shown in FIG. 22, in the opposite direction from when the sheet is drawn onto the reel to unwind the sheet material from the reel and lay it directly upon the lane surface.

Figure 21:
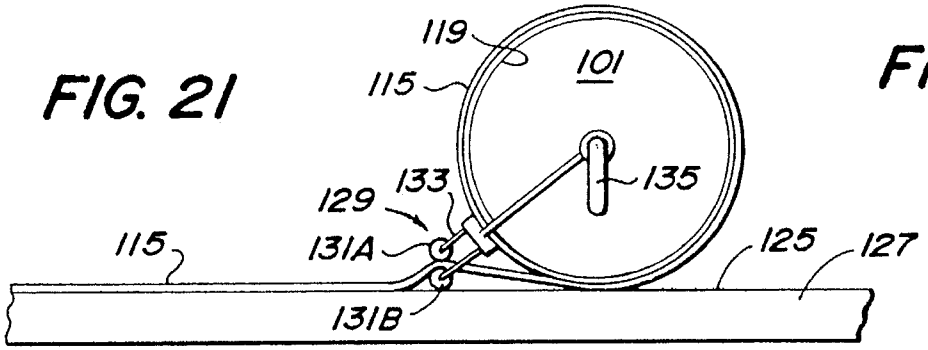
FIG. 21 is a diagrammatic view of a bowling lane upon which an oiless surface sheet material is being laid in accordance with the invention.

As the sheet is rolled out upon the bowling lane by rolling the reel along the lane, is is preferable to move a split heat source along behind the reel which heat source passes on both sides of the sheet material reheating it from both sides to encourage it to lie flat against the lane surface by relieving stresses in the upper and lower portions of the continuous oiless sheet. This is shown in FIG. 21 where the reel 101 is shown passing over or rolling along the surface 125 of a bowling lane 127 laying a continuous sheet of oiless surface sheet material 115 on the surface 125. The continuous sheet first passes through a heating device 129 comprising two internally heated rollers 131A and 131B which pass respectively against the top and bottom of the oiless sheet material 115. The heated rollers may be electrically heated to a temperature just sufficient to relieve the stresses in the plastic, but not sufficient to cause deformation or slumping of the plastic. The heating device 129 may be drawn along with the reel 101 by a harness arrangement 133 securing it essentially to the axis or a temporary axle of the reel such as a bar 135 extended through the center of the reel which may also be used to manually move the reel down the lane. A radiant heating lamp arrangement may be used in place of the heated rollers 131 to reduce stresses in the plastic.

Figure 23:
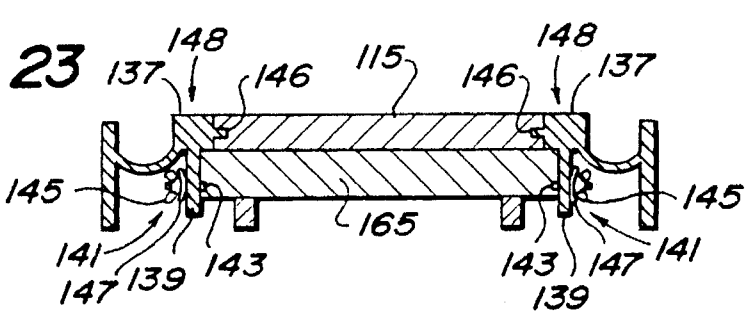
FIG. 23 is a cross section of the bowling lane shown in FIG. 22 showing a preferred side interengagement arrangement.
Figure 22:
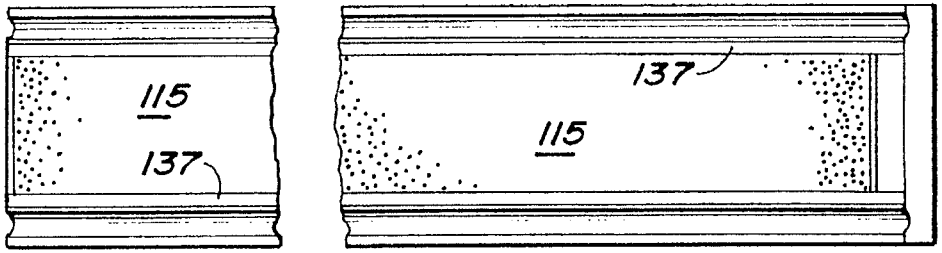
FIG. 22 is diagrammatic plan view of a bowling lane with the continuous oiless surface laid thereupon as shown in FIG. 21.

The oiless sheet material 115 laid out flat on the lane surface is shown in FIG. 22. The ends of the oiless sheet material are left open at the ends to allow for longitudinal expansion while the sides are resiliently retained by maple or other natural or artificial wood strips 137 arranged so they can be moved outwardly to allow the oiless sheet material to be laid down and then moved inwardly to resiliently clamp against the sides of the oiless sheet material to retain it in place. The finishing strips 137 are retained in place by a series of spaced retainer bars 139, as shown in FIG. 23 which is a diagrammatic cross section of the lane shown in FIG. 22 with one of the oiless sheets retained on the surface. The retainer bars 139 are mounted on the side of the lane by means of threaded retainer fastenings 141 comprising a threaded rod 143 with a retainer means such as a wing nut 145 or the like bearing upon an intervening resilient means such as a spring or lock washer 147, which in turn bears against the retainer bar 139 to retain the finishing or retainer strips 137 against the sides of the oiless lane material.

Preferably, as shown in FIG. 23, the retainer or finishing strips 137, which are the same height or thickness as the oiless lane material 115 so that balls can easily pass over the strips from the oiless surface into the gutter of the bowling lane, are interengaged with the oiless sheet material in any suitable manner, preferably by a tongue-and-groove arrangement in which a groove 146 provided on the side of the sheet material is interengaged with a tongue on the side of the retainer strips. Such groove is preferably formed on the side of the sheet during extrusion. The side-to-side expansion of the oiless sheet may be in the neighborhood of one- to three-sixteenths of an inch at most so that the resilient springs or lock washers require only slightly more range of movement or play than this. The continuous oiless sheet may experience a longitudinal expansion of one-half inch or even more with temperature changes, but such expansion can readily occur since the ends of the oiless sheet can be left unencumbered with perhaps a half-inch gap preferably filled with a resilient filler material, not shown, at the head end and completely open at the far end where the passage of the ball from the end of the lane to the pin setting area can involve a relatively short drop without affecting the trajectory of the ball. The interengagement side clamp surfaces 148 of the retainer or finishing strips 137 with the side of the continuous sheet material 115 can take several forms such as a triangular extension in a V-groove and the like in addition to a more conventional tongue-and-groove arrangement. The described arrangement allows the oiless sheet to adjust as a unit as heat changes engender dimension changes sliding outwardly both with respect to its width and length in the space afforded between the finishing strips 137 as well as contracting without opening transverse spaces and followed continuously by the side finishing strips. This allows complete freedom of movement so that no buckling is engendered by the heat changes. It will be found that, if the oiless sheet is sufficiently flat, there will be no tendency of the continuous sheet to warp with resultant unevenness of the surface of the bowling lane.

It will be understood, that when it is desirable to turn the oiless sheet material over to make use of the opposite unworn surface, such sheet does not need to be re-reeled upon the reel 101, but that the retainer fastenings 141 need merely to be loosened to release their interengagement with the sides of the oiless sheet so that the sheet may then be flipped from one surface to the other to make use of the other side. After both sides of the oiless sheet have become worn, a new continuous sheet surface with a length sufficient to cover the entire bowling lane will be shipped to the bowling site on the large reel 101 and will again be unreeled onto the bowling surface as explained above. In the meantime, however, since the worn sheet is to be shipped off site, it may be redrawn onto the reel 101, while the reel is mounted upon the skid arrangement 103 by first clamping it with the clamp 117 and then operating the motor 107 to turn the reel in the proper direction to re-reel the sheet onto the reel 101, withdrawing it from the side clamp surfaces 148. At this time, heating means such as the heat lamps 121 may be desirably used to facilitate bending of the sheet material to get it onto the reel. The entire apparatus, including the skid, will have been shipped to the lane to facilitate return of the oiless sheet for re-embossing or, alternatively, just the reel may be provided for the shipping. Alternatively, the sheet may be shipped without reeling or some means provided for local re-embossing.

As indicated above, it is desirable not to hold down the oiless sheet surface with any sort of permanent adhesive, since such permanent adhesive will inevitably become stuck to the surface and may in such case not only cause damage to the surface during its removal but, if it is not removed, will in itself constitute a defect on the surface which will interfere with smooth rolling of a ball across the surface. Consequently, it is desirable not to permanently adhere the sheet to the lane by any adhesive or the like. The present inventor has found that temporary adherency of the sheet material to the underlying surface may be obtained very practically by providing a vacuum arrangement to hold down the sheet. Since the low spots in the oiless surface embossment of the sheet are desirably, as explained above, not extended completely through the sheet, but remain only low points between high points over which the surface of a bowling ball passes as it rolls or partially slides down the sheet, the sheet has no perforations which would disturb application of a vacuum. Moreover, it is not necessary, in most cases, for the entire sheet to be embossed, since the ball will be desirably rolled only in the central portion of the sheet in any case. Any rolling of the ball along the edges of the sheet is undesirable in any event and whether or not the embossing extends to the edges will have little effect upon the final results obtained by any deviant balls. By not having the embossing of the surface extend to the edges, therefore, it becomes easier to seal the edges of the surface with a suitable vacuum-sealing material. However, even if the embossing does extend to the edges, a very flexible sealing means may be used which will completely fill in the surfaces over and between the high points of most embossed sheets allowing a satisfactory vacuum to be drawn. In order for the vacuum to extend completely under the sheet so that the entire sheet is pulled down against the base, it is necessary that the actual surface of the sheet be held away from the base at regular or at least-spaced points so that the vacuum has access to a large, relatively uniform portion of the entire bottom of the sheet at one time. It has been found that this requirement can be met very satisfactorily by use of a metal base sheet surface having a series of protrusions on it. One very satisfactory surface to use is the customary design used for non-slip metal surfaces in which a series of double prisms or diamond shapes arranged in intersecting rows extend across the surface of the sheet. Such embossments may be found upon aluminum sheets or plates or steel sheets and plates used for non-slip walking in manufacturing plants. Such metal sheets have sufficient rigidity to supply a very solid under-surface to serve as a base for an oiless sheet in accordance with the invention and also provide a surface which not only solidly supports the underside of the oiless sheet, but also allows vacuum to reach almost any portion of the sheet surface. The sides of the supporting metal sheet surface may be filled in with a flexible sealing medium such as, for example, a flexible rubber or other soft resilient and conforming surface which will seal itself not only with the base sheet, but also upon contact with the oiless sheet surface above and allow the vacuum between the two to pull the surface of the oiless sheet securely against the underlying metal support surface.

Figure 24:
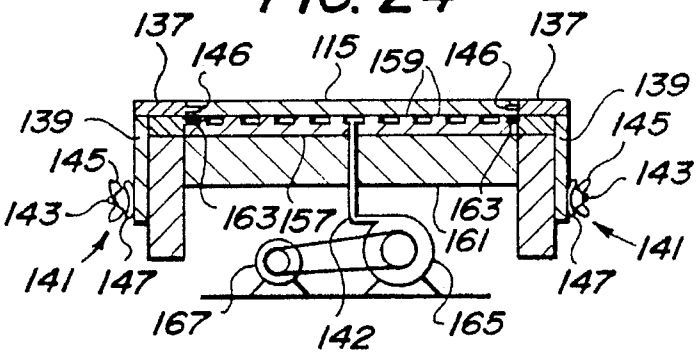
FIG. 24 is a diagrammatic cross section of a vacuum arrangement for retaining a bowling lane surface material upon the lane.
Figure 25:
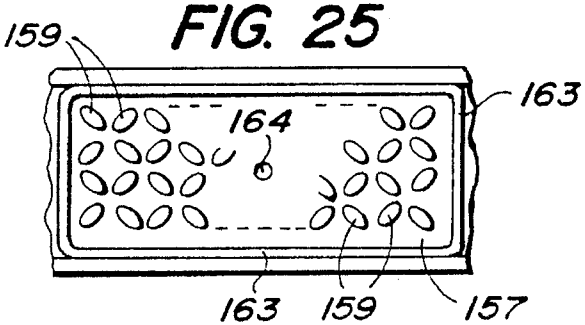
FIG. 25 is a plan view of a preferred bowling lane base or support sheet used in the vacuum arrangement shown in FIG. 24.
Figure 26:
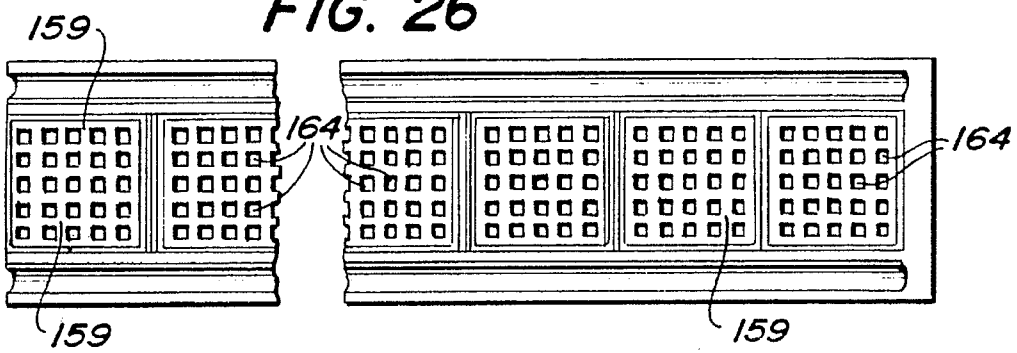
FIG. 26 is a plan view of an alternative base or support sheet for a vacuum system in accordance with the invention using a plurality of 0-ring sealing means to provide separate vacuum spaces upon the base or support sheet or sheets for retaining a single continuous sheet lane surface material or upon occasion multiple sheet lane surface material upon a bowling lane.

A suitable arrangement for a vacuum system is shown diagrammatically in FIG. 24 in which an oiless sheet material 115 is shown being pulled down upon a metal base sheet 157. Such base sheet has a series of upper protrusions 159 in the shape of a series of intersecting lines of elongated diamonds, as better shown in FIG. 25. The metal base sheet 157 may be mounted upon a series of cross members 161 which serve as supporting members for the lane. Any other suitable supporting framework may be used. Adjustable side finishing strips 137 are shown on the sides in FIGS. 24 and 25 adjacent to the top of the oiless sheet material 115 as in previous views to stabilize it from the side and also to provide a side to the open area between the diamond-shaped protrusions 159 so that the vacuum will be applied to the bottom of the sheet 115 and provides some aid in excluding air flowing in from the side. However, the principal sealing along both the sides as well as the ends of the continuous oiless surface sheet is by a series of sealing O-rings 163 shown along the edge of the sheet as shown in FIG. 25 and shown as a complete O-ring 163 resting upon the metal base 157 around the outside. It will be understood that a series of O-rings 163 will normally be laid along the length of the one-piece lane surface each surrounding a vacuum intake 164 in one of the base sheets 157 which need not be continuous, but may be individual base sheets spaced along the lane to form the complete base for the oiless lane surface as shown in FIG. 26. It is convenient to use a single base sheet, however, as this avoids the necessity of sealing between adjacent base sheets. However, even with a single base sheet, it is desirable to use a series of O-rings and vacuum inlets as shown in FIG. 26. The O-rings effectively seal the space between the metal base 157 and oiless sheet material 115 when a vacuum is drawn by a pump 165 operated through a motor 167. The decreased air pressure, which need not be much lower than normal air pressure in order to thoroughly depress a large sheet against the underlying support material 157, gains access to the space between the sheet 115 and the bottom or base supporting sheet 157 through a vacuum line 142. It will be understood that while the design of intersecting rows of elongated diamonds shown in FIG. 25 has been found very satisfactory as a vacuum support base, many other shapes might also be used and one of the prime advantages of the diamond shape is its relative availability on the market, since sheets of this design are made commonly for use in industrial environments as slip-resistant surfaces where a steel or other metal pedestrian or walking surface is desirable or necessary. Various means for providing a vacuum between the sheets and for sealing the sheet surfaces against the vacuum may be used without departing from the basic invention.

As indicated above, the use of a vacuum is particularly desirable because it leaves no residue on the surface of the sheet and may be readily removed at any time. In fact, as again indicated above, it will often be found that the sheet surface will become sufficiently flat so that the vacuum does not need to be used at all times, but may be used only during actual bowling or even only when the oiless sheet shows signs of incipient warping.

It will be understood from the above description that while the use of a large one-piece reel-transported lane surface and/or a vacuum arrangement to hold it down is particularly effective and useful with oiless lane surfaces, it may also be applied to lane surface material having a substantial thickness such as about one-eighth to one-quarter inch or more which does not incorporate an oiless or embossed surface.

It will also be seen from the foregoing that the present invention provides a very effective and practical oiless surface for a bowling alley which allows the usual mineral oil base conditioner applied to the surface to be eliminated while retaining all the advantages of the use of the oil and eliminating the disadvantages. The non-friction surfaces of the lane forming sheets of the invention are both strong and durable and have an effective lubricity comparable to oiled surfaces without the contamination and variation in surface characteristics found in oiled surfaces. The surface can, if desired, be colored and marked to give the appearance of conventional wood lanes and can be renewed periodically either by turning over a sheet having the oiless surface incorporated on both sides or completely renewing the sheet. The surfaces of the sheets can also be renewed either on the lane or by special machinery which softens the surface and re-applies a pattern or, in case of an abraded surface, re-abrades it. The system of securing the lane surface to an existing lane illustrated in FIGS. 12 through 14 is particularly convenient because the oiless sheets can be easily removed and resurfaced away from the actual bowling lane.

In the foregoing description and explanation as well as in the accompanying claims, the following terms and descriptions are to be understood to have the following listed meanings:

(a) "lubricity"- the tendency of a one material to slide upon another or to pass across its surface with facility; opposed to friction.

(b) "reduced friction material" or "low friction material"- a material having an inherent relatively high lubricity, for example, smooth polyethylene, polypropylene, Teflon, Nylon and the like.

(c) "macro object"- a physical object having a size with respect to or in comparison with another object of the same general scale, for example, a bowling ball compared with a section of a bowling lane, i.e. not of widely varying size or scale.

(d) "discontinuous surface"- a surface which is interrupted by either raised portions or depressed portions, preventing the surface, in effect, from being smooth or even as a whole.

(e) "relieved surface"- a surface which is made, in effect, discontinuous by having different effective elevations over a given extent of the surface and particularly portions which are lower than the portions forming the surface normally contacted by adjacent macro objects.

(f) "oiless" or "oil-free surface"- a surface for use upon a bowling lane upon which oil need not be used, because such surface has a comparable, or at least broadly equivalent lubricity.

(g) "sheet" or "plate"- a physical structure having generally flat top and bottom surfaces more extensive in area than the sides.

(h) "effective surface"- a surface defined by either the average or majority elevation of such surface defining in effect a boundary for reaction against or contact by an external agency or macro object.

(i) "substantial up-and-down" or "substantial vertical movement"- movement of a bowling ball vertically in a repetitive, but not necessarily uniform, pattern as it passes across an extended effective surface, which repetitive vertical pattern of movement is sufficient to use up a significant amount of energy and to significantly retard or deviate a rolling bowling ball from forward movement.

(j) "sufficient mass for support"- an amount of a given material which when arranged together in a coherent mass will independently support the weight of a second given mass resting thereupon.

While the present invention has been described at some length and with some particularity with regard to several embodiments, it is not intended that the invention be limited to any such particulars or embodiments, but it is to be construed broadly with reference to the appended claims so as to provide the broadest possible interpretation of such claims in view of the prior art and thereby to effectively encompass the intended scope of the invention.

I claim:

1. A bowling lane surface eliminating discontinuities between separate synthetic plastic lane surface sheets comprising:

(a) a unitary synthetic plastic sheet having a width substantially equal to the full playing width of a bowling lane and a length substantially equal to the full playing length of the lane, (b) such synthetic plastic sheet having a thickness of at least three-sixteenths of an inch, and an upper surface suitable for passage thereover of bowling balls (c) overlap-type structural interengagement means disposed along both sides of the bowling lane contiguous with the lateral edges of the synthetic plastic sheet and interengaging with the edges of said synthetic sheet, (d) said interengagement means being resiliently biased against the lateral sheet edges of said synthetic plastic sheet to allow for expansion and contraction of said sheet and having essentially the same thickness as said sheet, and (e) the ends of said sheet being adapted for longitudinal movement along the lane proportional to expansion and contraction of the sheet longitudinally along the lane due to temperature changes of the sheet, (f) said synthetic plastic sheet having a lower surface which will freely slide longitudinally over any underlying contacting structures without constriction.

2. A bowling lane surface in accordance with claim 1 additionally comprising:

(f) a vacuum application system adjacent the lower side of said sheet acting to bias the lower surface of said sheet against a lower support surface thereunder while allowing longitudinal sliding movement of the synthetic plastic sheet over underlying bowling lane support structure.

3. A bowling lane surface in accordance with claim 2 additionally comprising:

(g) a series of protrusions extending upwardly from the lower support surface to establish a series of adjacent points against which a lower surface of said sheet may be stabilized and supported when biased against said protrusions by the effects of the vacuum.

4. A bowling lane surface in accordance with claim 1 wherein the synthetic plastic sheet is provided with interspersed low points and high points on one side thereof constituting an oiless bowling lane surface at least on the upper side of the sheet, the high points and low points being interspersed, with the high points being spaced sufficiently closely so that a bowling ball passing across the said surface will contact only the apexes of the high points without any substantial up-and-down movement.

5. A bowling lane surface in accordance with claim 4 wherein the synthetic plastic sheet is provided on both sides with the interspersed low points and high points.

6. A bowling lane surface in accordance with claim 4 wherein the interspersed low points and high points are regularly arranged with respect to each other.

7. A bowling lane surface in accordance with claim 4 wherein the low points and high points on the synthetic plastic sheet are substantially randomly arranged with respect to each other.

8. A method of providing a lane surface on a bowling lane wherein the lane surfaces is provided on a synthetic plastic sheet having a substantial thickness comprising:

(a) prefabricating a synthetic plastic sheet having a width substantially equal to the playing width of a bowling lane and a length at least equal to the playing length of the lane and a thickness greater than three-sixteenths of an inch, (b) reeling said sheet onto a reel having a diameter related to the thickness of the sheet such that reeling said plastic sheet upon the reel does not provide a substantially permanent curvature to the plastic sheet subsequent to removal from the reel, (c) transporting the plastic sheet upon the reel to a bowling lane site, (d) unreeling the plastic sheet from the reel to the lane, (e) mechanically engaging the sheet along its sides with a resilient interengagement means contacting the sides and upper surfaces of the sheet to hold down the sheet upon the lane while allowing transverse movement due to expansion and contraction, and (f) allowing the opposite longitudinal ends of the sheet unrestricted sliding movement with respect to longitudinal expansion and contraction of the sheet.

9. A method of providing a bowling lane surface in accordance with claim 8 wherein the synthetic plastic sheet is cut or sheared to the length of the lane upon which it is to be mounted prior to reeling.

10. A method of providing a bowling lane surface in accordance with claim 9 wherein the synthetic plastic sheet is initially prefabricated with an embossed surface having interspersed high points and low points.

11. A method of providing a bowling lane surface in accordance with claim 8 wherein the sheet after unreeling onto the lane surface is maintained in a flat condition by a relative vacuum applied to the underside of the sheet.

12. A method of providing a bowling lane surface in accordance with claim 10 wherein the sheet is prefabricated with a pattern of interspersed high points and low points on at least one side designed to provide an oiless bowling lane surface on such side by embossing and the sheet is unreeled with the pre-embossed side upwardly.

13. A method of providing a bowling lane surface in accordance with 12 wherein the sheet is prefabricated by embossing upon both sides and after an initially upwardly oriented side becomes worn, the sheet is reversed with respect to the upper and lower surfaces on the lane to bring the unworn side to the top.

14. An apparatus for holding a bowling lane surface material upon a bowling lane comprising:

(a) a laterally and longitudinally extended base applied to a bowling lane structure, said extended base incorporating a series of spaced flat top protuberances extending upwardly from said extended base, (b) a sealing material disposed upon the top of the base parallel to the edges thereof adapted to seal at least along the edges of the lower portion of a sheet carrying upon its upper surface a bowling lane surface when said sheet is supported upon the flat top protuberances.

(c) means for generating a reduced air pressure connected via orifice means to the space between the laterally and longitudinally extended base material and the sheet carrying a bowling lane surface, said means for generating a reduced air pressure being capable of drawing sufficient vacuum to retain a sheet having a bowling surface securely against the flat top protuberances.

15. An apparatus in accordance with claim 14 additionally comprising:

(d) interengagement means disposed adjacent the outer edges of the base adapted to resiliently interengage with the edges of a sheet carrying upon its surface a bowling lane surface.

16. An apparatus in accordance with claim 15 wherein the interengagement means comprises a side strip having a tongue on the side adapted to fit in a groove in a side of the sheet carrying the bowling lane surface.

17. An apparatus in accordance with claim 16 wherein the interengagement means is arranged and adapted to interengage with a sheet carrying a bowling lane surface which has a length substantially coextensive with the length of the playing surface of the bowling lane.

18. An apparatus in accordance with claim 17 wherein the sealing material between the base sheet having upwardly extending protuberances and a sheet carrying upon its surface a bowling lane surface comprises at least one O-ring.

19. An apparatus in accordance with claim 18 wherein the sealing means comprises a series of O-rings each defining a vacuum space between the base and a sheet carrying a bowling lane surface and having a connection to a vacuum source.

* * * * *